US008256835B2

(12) United States Patent
Brink et al.

(10) Patent No.: US 8,256,835 B2
(45) Date of Patent: Sep. 4, 2012

(54) SEAT WITH MOVABLE TABLET

(75) Inventors: James M. Brink, Grand Rapids, MI (US); John P. Conner, Grandville, MI (US)

(73) Assignee: Irwin Seating Company, Grand Rapids, MI (US)

( * ) Notice: Subject to any disclaimer, the term of this patent is extended or adjusted under 35 U.S.C. 154(b) by 374 days.

(21) Appl. No.: 12/577,361

(22) Filed: Oct. 12, 2009

(65) Prior Publication Data

US 2010/0090504 A1 Apr. 15, 2010

Related U.S. Application Data

(60) Provisional application No. 61/105,203, filed on Oct. 14, 2008.

(51) Int. Cl.
*A47B 83/02* (2006.01)

(52) U.S. Cl. ..... 297/162; 297/145; 297/161

(58) Field of Classification Search ..... 297/145, 297/155, 162, 161; 108/46, 49, 152; 248/278.1, 248/282.1, 284.1, 289.11, 291.1
See application file for complete search history.

(56) References Cited

U.S. PATENT DOCUMENTS

| | | | | |
|---|---|---|---|---|
| 1,849,926 | A * | 3/1932 | Holtkamp | 108/49 |
| 1,862,237 | A * | 6/1932 | Pepler | 108/49 |
| 2,518,381 | A * | 8/1950 | Runkles | 297/145 |
| 3,140,894 | A | 7/1964 | Hicke | |
| 3,197,254 | A | 7/1965 | Hendrickson | |
| 3,269,772 | A | 8/1966 | Brunskole | |
| 3,351,377 | A | 11/1967 | Anderson | |
| 3,547,488 | A | 12/1970 | Barnes | |
| 3,556,588 | A | 1/1971 | Monyer et al. | |
| 3,567,277 | A | 3/1971 | Van Ryn | |
| 3,572,831 | A | 3/1971 | Barecki et al. | |
| 3,598,442 | A | 8/1971 | Miller | |
| 3,675,968 | A | 7/1972 | Douglas | |
| 4,216,994 | A | 8/1980 | Benoit | |
| 4,372,604 | A | 2/1983 | Raksanyi et al. | |
| 4,848,833 | A | 7/1989 | Grall | |
| 4,852,940 | A | 8/1989 | Kanigowski | |
| 5,087,096 | A | 2/1992 | Yamazaki | |
| 5,490,710 | A | 2/1996 | Dearing et al. | |
| 5,683,136 | A | 11/1997 | Baumann et al. | |
| 5,816,649 | A | 10/1998 | Shields | |
| 5,845,964 | A | 12/1998 | Phoon | |

(Continued)

FOREIGN PATENT DOCUMENTS

DE 2826389 * 12/1979

(Continued)

*Primary Examiner* — David Dunn
*Assistant Examiner* — David E Allred
(74) *Attorney, Agent, or Firm* — Gardner, Linn, Burkhart & Flory, LLP

(57) ABSTRACT

A tablet adjustment mechanism is provided to control the movement of a tablet of a seat assembly between a lowered non-use or stowed position under the armrest and a raised or use position, and further control the tablet's movement between an inward use position and an outward use position. The adjustment mechanism includes a plunger inside of a pivot element, the plunger's longitudinal and rotational or pivotal movements being controlled by a pin engaging a slot in the plunger, and also by a guide pin traversing an arcuate slot in a tablet support arm. The adjustment mechanism may limit lateral or sideward movement of the tablet when the tablet is in its fully lowered or stowed position and during at least some of the pivotal movement toward its raised position.

21 Claims, 27 Drawing Sheets

U.S. PATENT DOCUMENTS

| | | | | |
|---|---|---|---|---|
| 6,073,997 | A | 6/2000 | Koh | |
| 6,220,658 | B1 | 4/2001 | Lukawski et al. | |
| 6,224,149 | B1 | 5/2001 | Gevaert | |
| 6,237,997 | B1 | 5/2001 | Olson | |
| 6,375,257 | B1 | 4/2002 | Wooding et al. | |
| 6,427,957 | B1 | 8/2002 | Finneman et al. | |
| 6,837,539 | B1 | 1/2005 | Casey | |
| 7,131,688 | B2 | 11/2006 | Steenson | |
| 7,143,701 | B2 | 12/2006 | Lindstrom et al. | |
| 7,210,736 | B1 | 5/2007 | Large | |
| 7,370,910 | B2 | 5/2008 | Piretti | |
| 7,478,868 | B2 | 1/2009 | Figueras Mitjans | |
| 2006/0109257 | A1 | 5/2006 | Ambasz | |
| 2006/0197362 | A1 * | 9/2006 | Mabon et al. | 297/172 |
| 2007/0132283 | A1 * | 6/2007 | Mitjans | 297/145 |
| 2008/0197678 | A1 | 8/2008 | Olarte | |
| 2009/0026812 | A1 | 1/2009 | Figueras Mitjans | |

FOREIGN PATENT DOCUMENTS

| | | | | |
|---|---|---|---|---|
| DE | 2826389 | Y | | 12/1979 |
| EP | 1464255 | A1 | | 10/2004 |
| EP | 1859707 | | * | 11/2007 |
| EP | 1859707 | A2 | | 11/2007 |
| ES | 282121 | U | | 5/1985 |
| ES | 1033482 | U | | 9/1996 |
| JP | 02291809 | | | 12/1990 |
| JP | 06191338 | A | * | 7/1994 |
| JP | 9206170 | Y | | 8/1997 |
| WO | 0232270 | | | 4/2002 |
| WO | 02102192 | | | 12/2002 |
| WO | WO 02/102192 | | * | 12/2002 |
| WO | 2008134801 | | | 11/2008 |

* cited by examiner

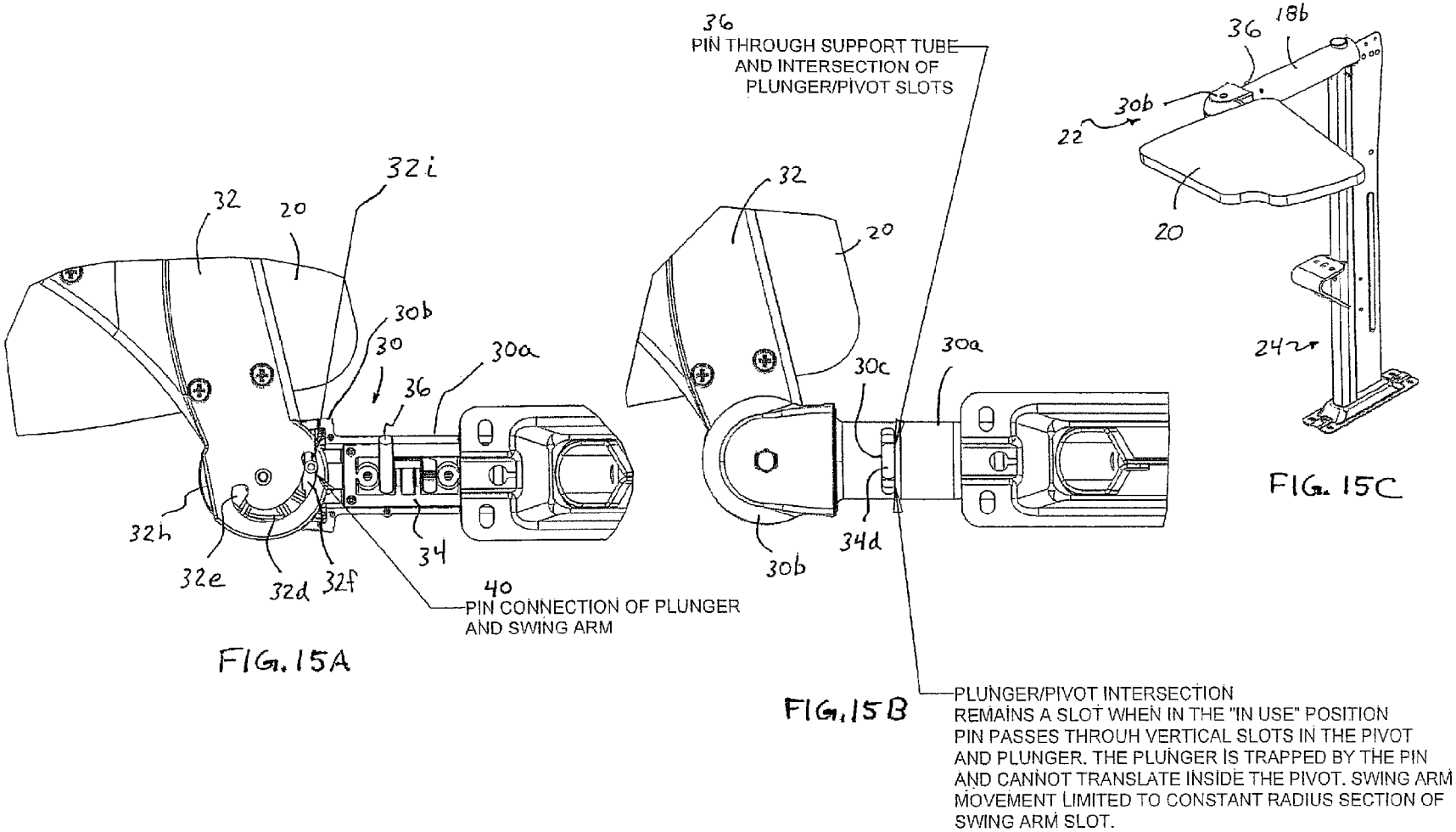
18b
36
30b
22
20
24
FIG. 15C
36
PIN THROUGH SUPPORT TUBE AND INTERSECTION OF PLUNGER/PIVOT SLOTS
32
20
30c
30a
34d
30b
PLUNGER/PIVOT INTERSECTION REMAINS A SLOT WHEN IN THE "IN USE" POSITION PIN PASSES THROUH VERTICAL SLOTS IN THE PIVOT AND PLUNGER. THE PLUNGER IS TRAPPED BY THE PIN AND CANNOT TRANSLATE INSIDE THE PIVOT. SWING ARM MOVEMENT LIMITED TO CONSTANT RADIUS SECTION OF SWING ARM SLOT.
FIG. 15B
32i
30b
30
36
30a
34
40
PIN CONNECTION OF PLUNGER AND SWING ARM
32f
32d
32e
32h
20
32
FIG. 15A

SEAT WITH MOVABLE TABLET

CROSS REFERENCE TO RELATED APPLICATION

The present application claims the benefit of U.S. provisional application, Ser. No. 61/105,203, filed Oct. 14, 2008, which is hereby incorporated herein by reference in its entirety.

FIELD OF THE INVENTION

The present invention relates to fixed seats and seating arrangements and, more particularly, to fixed seats arranged in rows at an auditorium or theater or the like that have a tablet or table portion that is movable between a stored or non-use position and a raised or use position.

BACKGROUND OF THE INVENTION

It is known to provide seats or chairs arranged in auditoriums or theaters or the like, with the seats having a table portion or tablet that is hingedly mounted to the seats and movable between a lowered or stored or non-use position and a raised or use position. Typically, the tablets are disposed at an outer side of a leg or support of the seat when in their lowered position. Typically, when the tablets are raised to their use position, the tablets are not adjustable when in the generally horizontal use position.

SUMMARY OF THE INVENTION

The present invention provides a seat assembly having a tablet adjustment mechanism that provides controlled movement of a tablet relative to the armrest of the seat assembly. The adjustment mechanism limits lateral movement of the tablet when the tablet is lowered or at least partially lowered to or toward its stored or stowed position, where the tablet may be disposed substantially directly or immediately below and centered below the armrest. The adjustment mechanism allows for adjustment of the tablet when in its generally horizontal use position.

According to an aspect of the present invention, a seat assembly includes a seat portion, an armrest portion and a tablet movable between a stored position and a use position via an adjustment mechanism. The tablet is generally centered beneath the armrest portion when in the stored position, and the adjustment mechanism limits sideward movement of the tablet when the tablet is in the stored position.

According to another aspect of the present invention, a seat assembly includes a seat portion, an armrest portion having a support arm, a tablet, and an adjustment mechanism. The tablet is movable between a stored position and a use position via the adjustment mechanism. The adjustment mechanism includes a pivot element and a plunger element. The pivot element is mounted to the support arm, and the plunger element is movable relative to the pivot element in response to movement of the tablet toward the raised position. A pin element is at least partially received through a slot in the pivot element and a slot of the plunger element. The plunger element is longitudinally moved along the pivot element in response to pivotal movement of the tablet about a pivot axle at the pivot element, and the pin element moves along a longitudinal slot portion of the slot of the plunger element when the plunger element moves along the pivot element. When the plunger element is longitudinally moved a threshold amount relative to the pivot element, the pin element is positioned at a generally transverse slot portion of the slot of the plunger element and the plunger element and the tablet are pivotable about a longitudinal axis of the plunger element when the pin element is positioned at the transverse slot portion. Optionally, the transverse slot portion may have an angled portion that allows the tablet to be pivotable about the longitudinal axis of the plunger element and about the pivot axle, such as while the tablet is moved between the in-use position and an intermediate or partially lowered position of the tablet.

Therefore, the present invention provides for controlled movement of a tablet of a seat assembly (such as a fixed seat assembly of a seating facility, such as an auditorium or the like) between its lowered non-use or stored position under the armrest and its raised or use position and further between its inward use position and outward use position. The adjustment mechanism may provide for a stored position of the tablet that is substantially centered beneath the armrest and may limit lateral or sideward movement of the tablet when the tablet is in its fully lowered or stored position and during at least some of the pivotal movement toward its raised position, thereby allowing for a reduced spacing between adjacent seats and limiting damage to the tablet or seat that may otherwise occur if the tablet were allowed to swing laterally in its stored and/or lowered positions. The adjustment mechanism may allow for adjustment of the tablet back and forth when in its generally horizontal use position to provide enhanced ergonomics and safety to the user. Therefore, the present invention provides a seating assembly or seating system with an adjustable tablet that is readily raised and lowered, via an adjustment mechanism that provides for controlled movement of the tablet throughout its range of motion.

These and other objects, advantages, purposes and features of the present invention will become apparent upon review of the following specification in conjunction with the drawings.

BRIEF DESCRIPTION OF THE DRAWINGS

FIGS. 15A-C are side elevations and perspective views of the tablet adjustment mechanism when the tablet is in its raised or use position;

DESCRIPTION OF THE PREFERRED EMBODIMENTS

Figure 1:
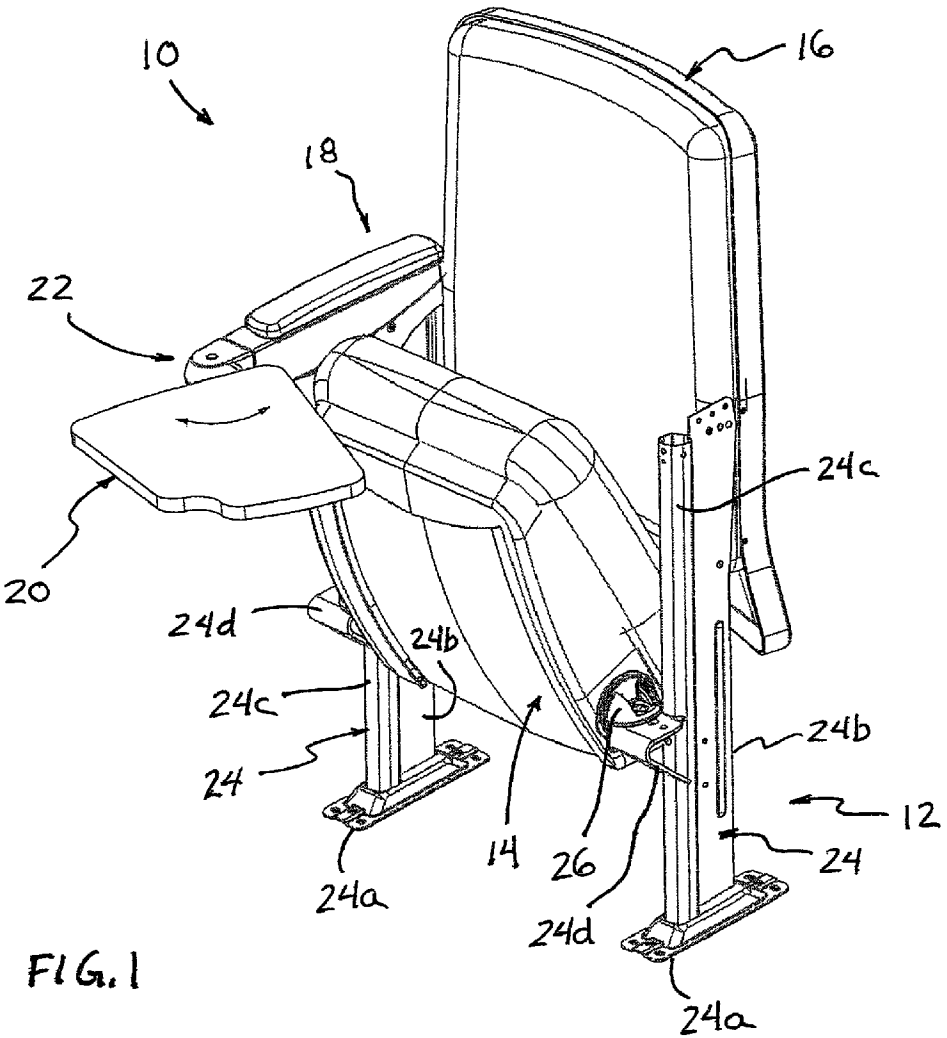
FIG. 1 is a perspective view of a seat assembly in accordance with the present invention, shown with the tablet in a raised or use position.
Figure 3:
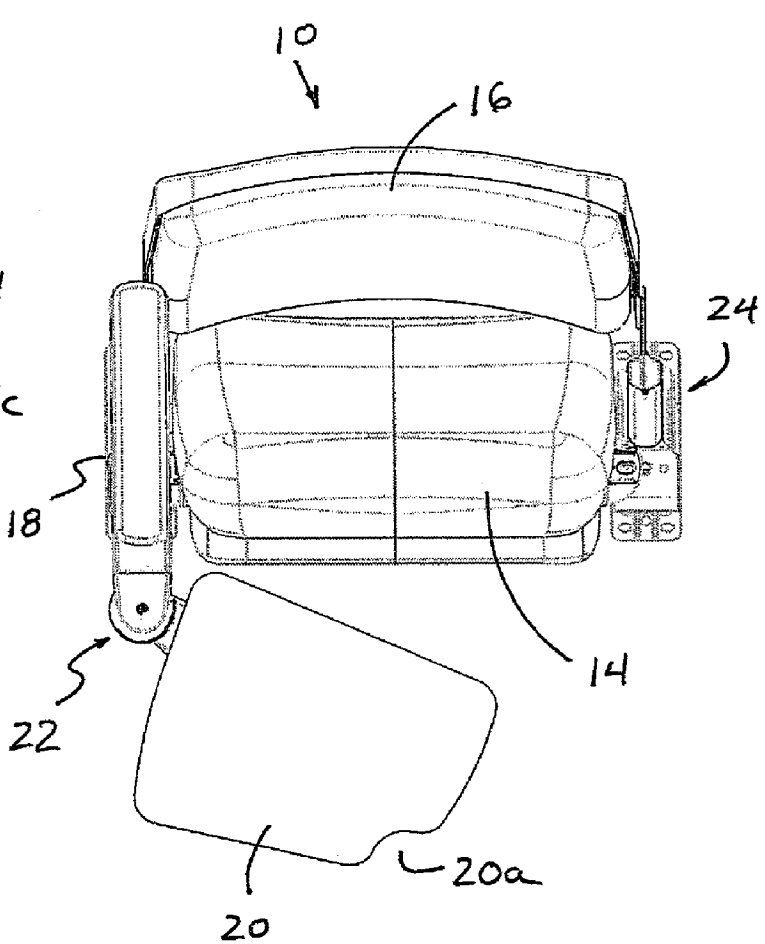
FIG. 3 is another top plan view of the seat assembly of FIG. 1, shown with the tablet pivoted away from the seat.
Figure 2:
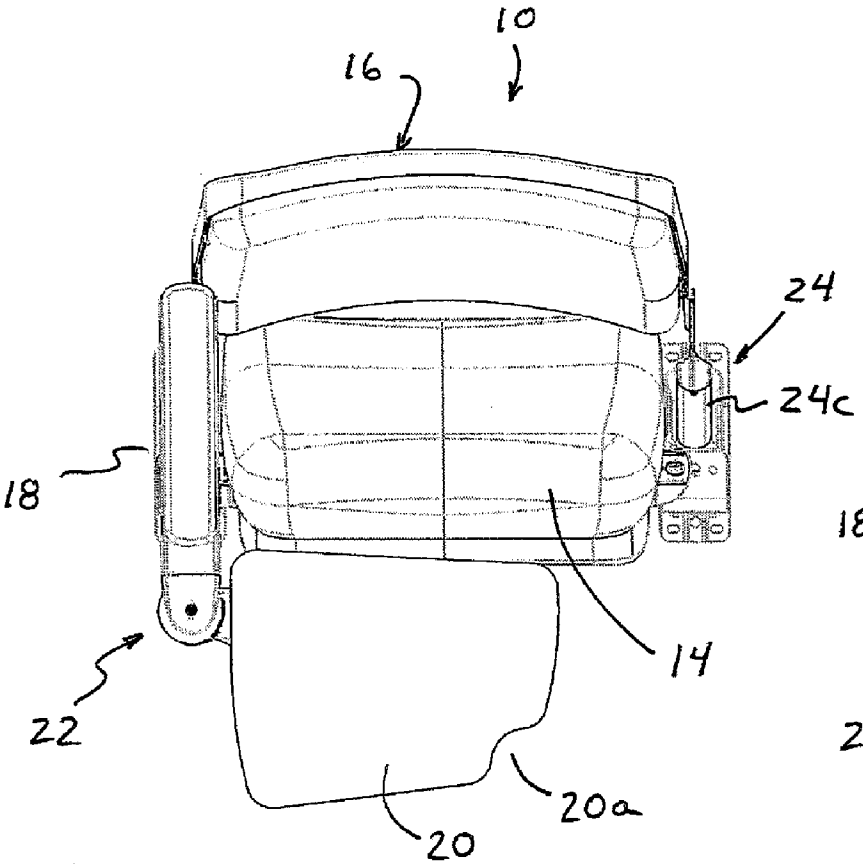
FIG. 2 is a top plan view of the seat assembly of FIG. 1, shown with the tablet pivoted toward the seat.
Figure 4:
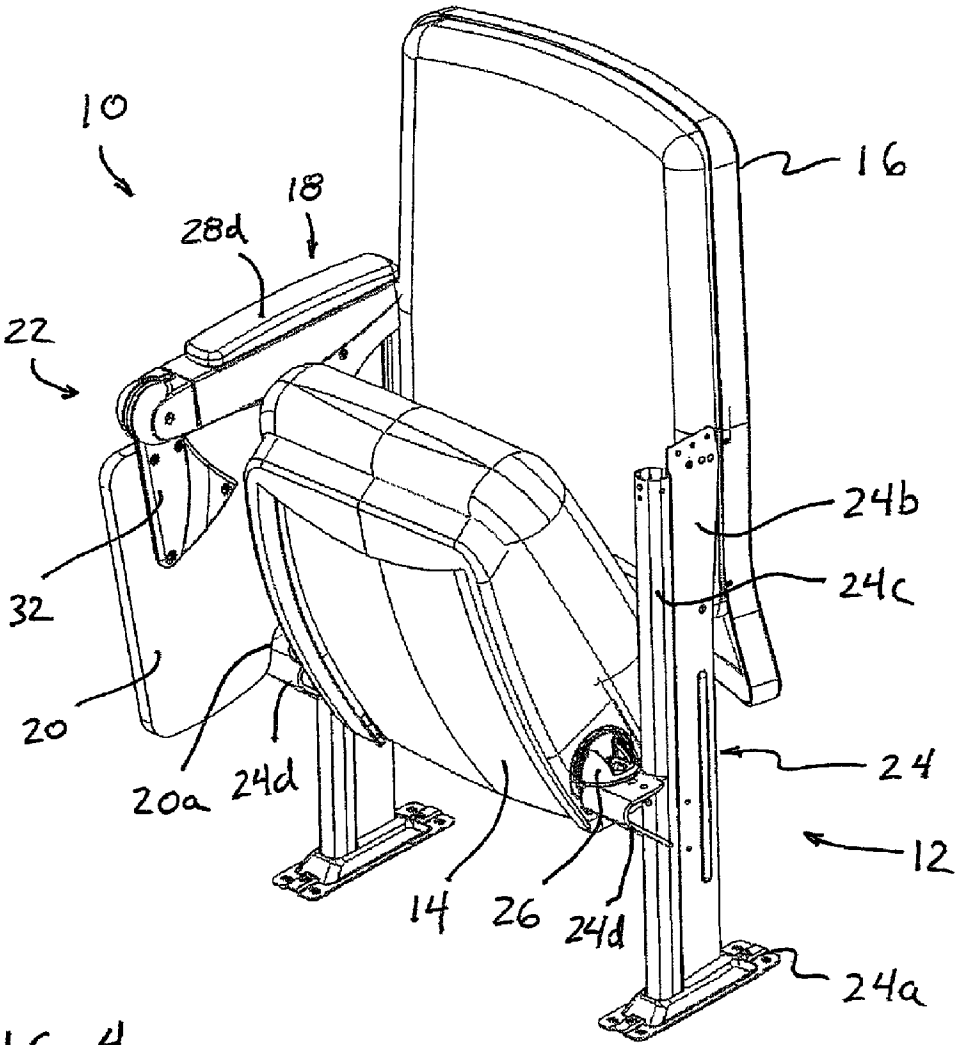
FIG. 4 is another perspective view of the seat assembly of FIG. 1, shown with the tablet in a lowered or non-use position.
Figure 5:
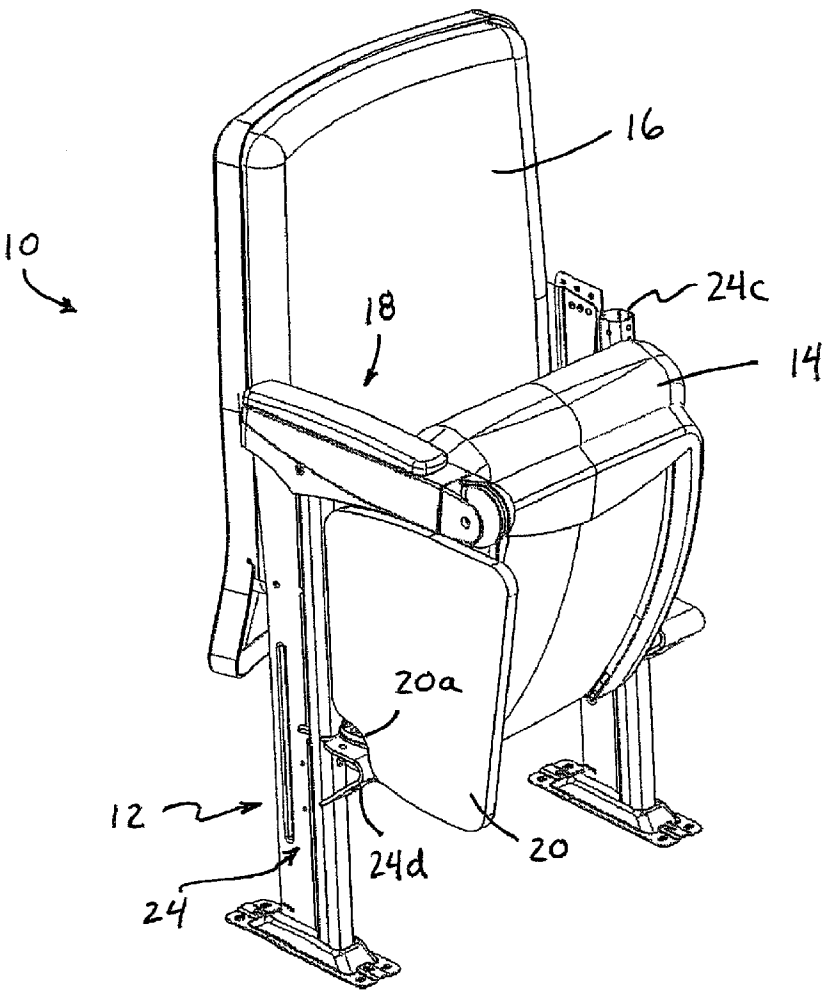
FIG. 5 is another perspective view of the seat assembly of FIG. 4.

Referring now to the drawings and the illustrative embodiments depicted therein, a seat assembly or chair assembly 10 includes a support assembly or support legs or stanchions 12 that support a seat portion 14, a back rest portion 16 and an armrest or arm support 18 with an adjustable or movable tablet or table 20 disposed thereat (FIGS. 1-7). Tablet 20 is adjustable between a raised or in use position (as shown in FIGS. 1-3) and a lowered or non-use position (as shown in FIGS. 4-7) via an adjustment mechanism or device 22. Adjustment mechanism 22 allows for movement of the tablet between the use and non-use positions and allows for adjustment of the tablet when in the use position between a pulled-in position (FIG. 2) and pushed-out position (FIG. 3), as discussed below. When the tablet 20 is lowered to its non-use position, adjustment mechanism 22 allows for storage of the tablet directly or immediately below and generally or substantially centered below the armrest 18 and limits lateral movement of the tablet when in the storage position, so that the tablet does not extend laterally beyond the lateral dimensions of the armrest, as also discussed below.

The support assembly or structure 12 comprises a pair of mounting or support legs 24 that support the seat portion 14 and back rest portion 16 at a seating facility, such as an auditorium or stadium or theater or the like. In the illustrated embodiment, each leg 24 comprises a floor mounted base or post for securing to a floor or support structure (such as via fasteners or bolts or the like securing a base plate to the floor of the seating facility). A seat support and pivot mechanism 26 may be attached to the respective legs 24, and pivotally or adjustably supports the seat portion 14 at and generally between the legs 24. Although shown as a floor mounted supports or legs, the supports or seat assembly may be mounted to other support structures or the like via other types of base or mounting portions, such as a platform mount, a riser mount, a beam mount, a rocker mount, a riser rocker mount, a slope mount or a multi-slope mount or rocker, without affecting the scope of the present invention.

Figure 9:
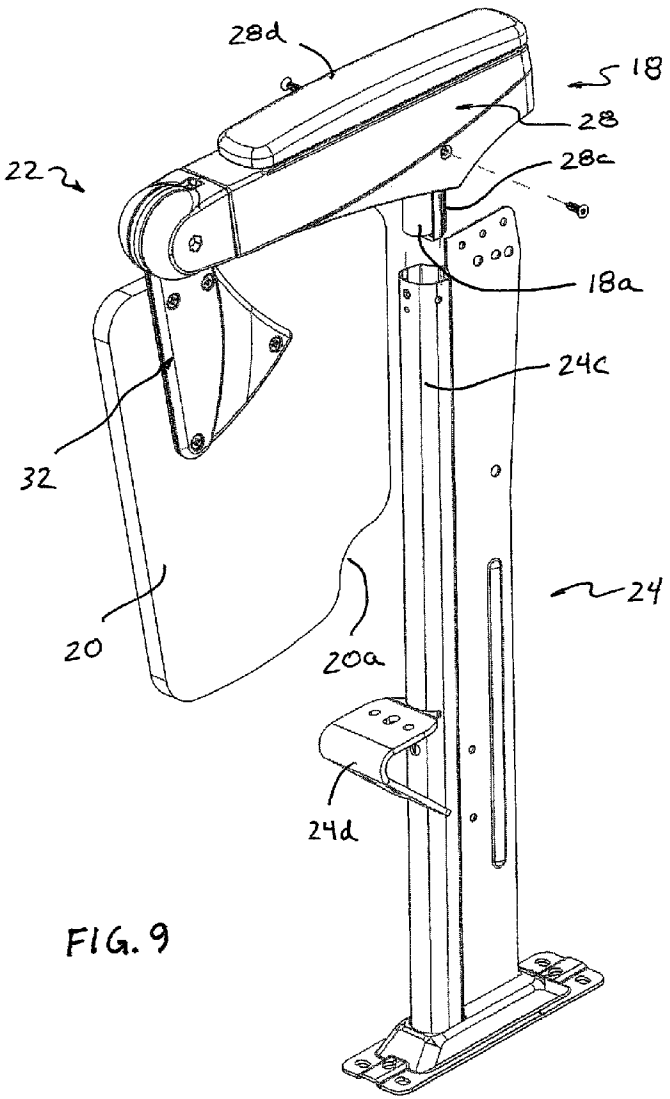
FIG. 9 is an exploded perspective view of the mounting leg and armrest assembly of FIG. 8, shown with the armrest assembly detached from the mounting leg.

In the illustrated embodiment, each support leg 24 comprises a base portion or plate 24*a* for attaching to the floor or other structure at the seating facility and a generally vertical panel or support member 24*b* extending generally vertically upward from base portion 24*a*. The support member 24*b* may include or may be associated with a generally vertical tube or hollow member 24*c* that has an upper end that is configured to receive a mounting post 18*a* of armrest 18 (as can be seen in FIG. 9) to support the armrest 18 at the upper end of the support leg 24. A bracket 24*d* is attached to the tube member 24*c* and is configured to mount or support or attach to the seat support and pivot mechanism 26 to pivotally or adjustably mount the seat portion 14 at the support legs 24. In the illustrated embodiment, the tablet 20 is shaped with a notch or recess 20*a* to accommodate the bracket 24*d* when the tablet is in its lowered position (as can be seen with reference to FIGS. 4 and 5), and thus may optimize or enhance the overall size of the tablet.

Seat portion 14 and back portion 16 may comprise any suitable seat portions and back rests or portions, and may vary in size and shape depending on the particular application of the seat assembly 10. The seat portion 14 and/or back portion 16 may be padded and/or upholstered as desired. Desirably, the seat portion may be pivotally or adjustably mounted to the support legs, but the seat may otherwise be fixedly mounted to the support legs while remaining within the spirit and scope of the present invention. Likewise, the back portion may be pivotally or adjustably mounted to the support legs or may be fixedly mounted to the support legs, while remaining within the spirit and scope of the present invention.

As discussed above, armrest 18 (with adjustment mechanism 22 and tablet 20) is mounted at the upper end of one of the support legs 24, such as, for example, at the right support leg (as shown in FIGS. 1-7) for supporting a tablet for a right-handed person to use while sitting in the seat or at the left support leg for supporting a tablet for a left-handed person to use while sitting in the seat. Another armrest (not shown) may be mounted at the other support leg and the other armrest would not necessarily include the adjustment mechanism and tablet or may include an adjustment mechanism and tablet for the seat adjacent to the first seat. The armrest 18 with the adjustment mechanism and tablet thus may be mounted at either or both support legs, depending on the particular application of the seat assembly. For example, each support leg may have an armrest and adjustment mechanism and tablet mounted thereto, with each support leg being a left leg for one seat and a right leg for an adjacent seat, such as for a plurality of seats arranged in a row at a seating facility. The adjustment mechanisms and tablets may be configured to be right hand tablets (with the tablet for a particular seat mounted to the right support leg of that seat) or left hand tablets (with the tablet for a particular seat mounted to the left support leg of that seat), depending on the particular application of the seat assemblies.

Figure 10:
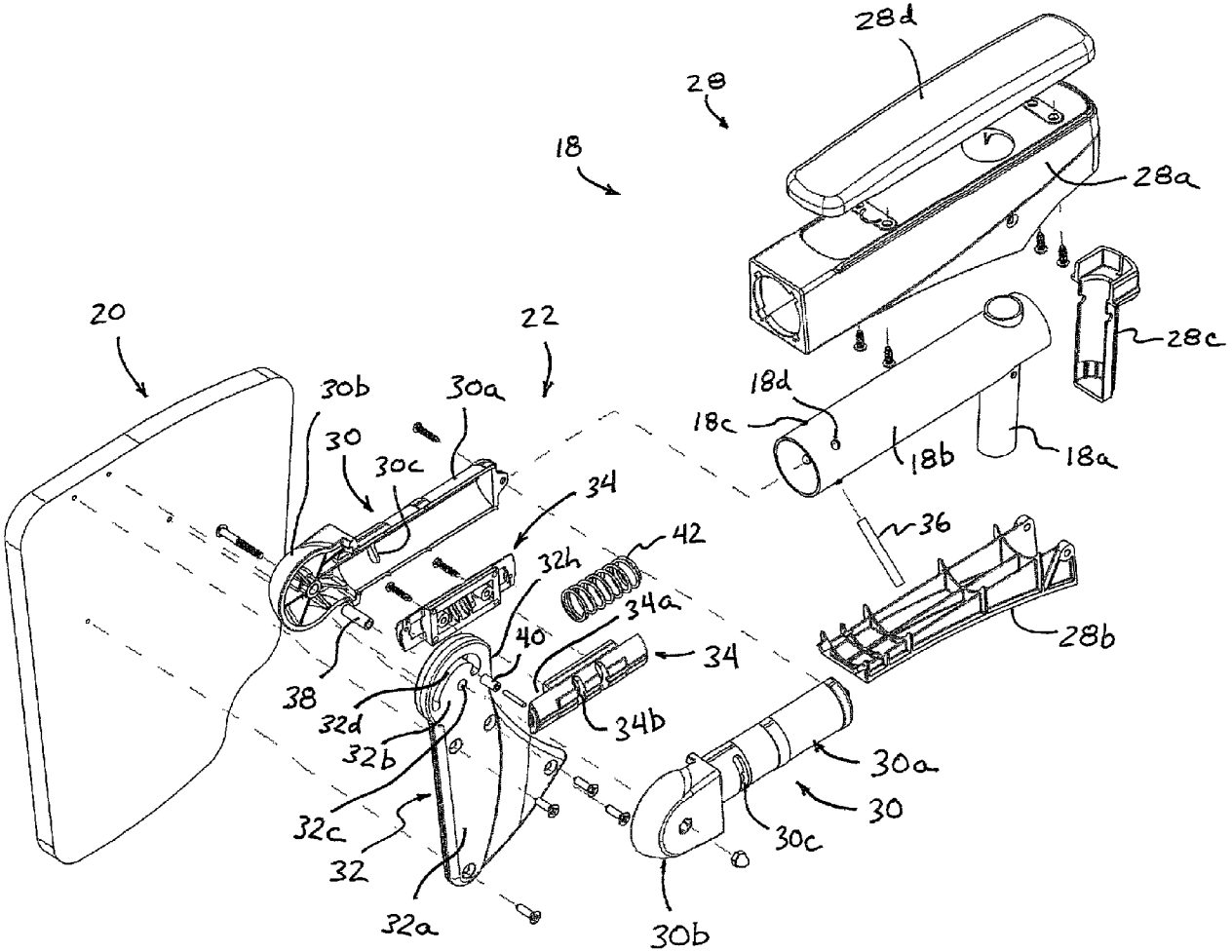
FIG. 10 is an exploded perspective view of the armrest assembly of FIG. 9.

In the illustrated embodiment, armrest 18 includes mounting post 18*a* that engages or is received in tube member 24*c* of support leg 24, and that may be secured to the tube member 24*c*, such as via one or more retaining elements 24*e* (FIG. 9), such as a screw or pin or the like. As shown in FIG. 10, armrest 18 includes a generally horizontal support or tube member 18*b* that is attached to mounting post 18*a*. Tube member 18*b* and mounting post 18*a* are received or contained at least partially within a housing or armrest casing 28, which may include an upper casing 28*a*, a lower casing 28*b* and a rear casing portion 28*c*, and which may include a padded armrest portion 28*d* at an upper surface thereof. Rear casing portion 28*c* may be formed to receive a portion of mounting post 18*a* and may provide a non-circular portion of the mounting post that is received in a non-circular tube member 24*c* to non-pivotally mount armrest 18 to support leg 24, Support or tube member 18*b* extends generally horizontally to an open end portion of the casing 28, and is configured to receive or attach to adjustment mechanism 22 to adjustably mount tablet 20 at the forward or outer end of the armrest 18.

Adjustment mechanism 22 is adjustable to pivotally mount tablet 20 at the outer end of the armrest. The adjustment mechanism is configured to allow for pivotal movement of tablet 20 about a generally horizontal pivot axis that is generally normal to the longitudinal axis of the armrest and support tube to facilitate movement between the lowered or stowed or non-use position beneath armrest 18 and the raised position. The adjustment mechanism is also configured to allow for pivotal movement of tablet about a pivot axis that extends generally longitudinally along support or tube member 18*b* to facilitate pivoting of the tablet to its generally horizontal in-use position. Further, the adjustment mechanism is also configured to limit pivotal movement of the tablet about the longitudinal pivot axis when the tablet is in its lowered or stored position and until the tablet is raised or pivoted upward a threshold amount. The adjustment mechanism is also configured to allow pivotal movement of the tablet about a generally vertical pivot axis when the tablet is in its generally horizontal in-use position to facilitate adjustment of the tablet relative to the person using the tablet at the seat assembly.

In the illustrated embodiment, adjustment mechanism 22 includes a pivot housing or pivot element 30 that includes a pivot shaft portion 30*a* that is received in support tube 18*b* and a tablet mounting portion 30*b* that pivotally mounts a swing arm or mounting arm 32 (which is attached or affixed to tablet 20, such as via a plurality of fasteners or the like). Shaft portion 30*a* has a transverse slot 30*c* formed therethrough that extends transverse to the longitudinal axis of the shaft portion 30*a*. Pivot element 30 receives a plunger 34 therein that is longitudinally movable along pivot element 30 in response to pivotal movement of swing arm 32 about tablet mounting portion 30*b* of pivot 30, as discussed below. When pivot shaft portion 30*a* is received within support tube 18*b*, a pin or stop element 36 is inserted at least partially through support tube 18*b* (such as through a hole or set of holes 18*c* or 18*d* of support tube 18*b*) and through slot 30*c* of pivot shaft portion 30*a* and at least partially through plunger 34 to allow for controlled pivotal and longitudinal movement of plunger 34 and pivot element 30 relative to support tube 18*b* to control the adjustment or movement of swing arm 32 and tablet 20 relative to armrest 18, as also discussed below.

Swing arm 32 includes a tablet mounting portion 32*a* that is configured to attach to tablet 20, such as via a plurality of screws as shown in FIG. 10, and a pivot mounting portion 32*b* that is configured to pivotally mount to tablet mounting portion 30*b* of pivot element 30. In the illustrated embodiment, pivot mounting portion 32*b* of swing arm 32 is pivotally mounted to mounting portion 30*b* of pivot element 30 via a pivot pin or axle 38. Pivot mounting portion 32*b* includes a hole or aperture 32*c* therethrough for receiving pivot axle 38 and includes an arcuate or variable radius slot 32*d* at least partially around hole 32*c* and along a perimeter region of pivot mounting portion 32*b*. The arcuate slot 32*d* has different radii from the pivot hole 32*c* that vary from a smaller radius portion 32*e* to a larger radius portion 32*f*. The pivot mounting portion 32*b* has a generally arcuate or curved perimeter region 32*g* and includes a generally flat or non-curved stop surface 32*h* (generally at or near the smaller radius portion 32*e*) for engaging plunger 34 to longitudinally move or adjust plunger 34 along pivot shaft 30*a*, as discussed below.

Plunger 34 is configured to be movably received within pivot shaft 30*a* and includes a slot or receiving portion 34*a* for receiving the perimeter region of pivot mounting portion 32*b* of swing arm 32. A pin or guide element 40 is inserted or received at least partially through plunger 34 and at least partially through or in arcuate slot 32*d*. Guide pin 40 functions to move along arcuate slot 32*d* as swing arm 32 is pivoted and to impart a longitudinal movement of plunger 34 in response to the pivotal movement of swing arm 32 about pivot axle 38 via the tracking of the guide pin 40 along the variable radius arcuate slot 32*d* of pivot mounting portion 32*b* of swing arm 32, as discussed below. In the illustrated embodiment, guide pin 40 is non-rotatable or rotationally fixed relative to plunger 34 so as to slidably track along arcuate slot 32*d* in a non-rotational or non-rolling manner. For example, guide pin 40 may be press-fit through apertures in the plunger or may be non-circular or keyed or otherwise formed so as to be received in a correspondingly formed non-circular aperture in the plunger to maintain the guide pin in a non-rotational state relative to the plunger. However, it is envisioned that guide pin 40 could be rotatably mounted to the plunger so as to rotate or roll as it tracks along the arcuate slot. Plunger 34 also includes a slot 34*b* through the body of plunger 34 for at least partially receiving pin or stop element 36 that is received at least partially through support tube 18*b* and through transverse slot 30*c* of pivot shaft portion 30*a*. Slot 34*b* of plunger 34 includes a longitudinal slot portion 34*c* (which extends longitudinally along plunger 34) and a transverse slot portion 34*d* (which extends normal to longitudinal slot portion 34*c*).

In the illustrated embodiment of FIG. 10, pivot element 30 and plunger 34 are shown as two-piece constructions, with the two halves or portions of each component being snapped and/or fastened or otherwise joined or connected together to form the pivot element and plunger components. However, it is envisioned that the pivot element and/or plunger may comprise unitary constructions or other constructions or forms, while remaining within the spirit and scope of the present invention.

In the illustrated embodiment, the curved perimeter region 32*g* of swing arm 32 provides a curved outer surface that generally corresponds to a curved or partial spherical-shaped outer surface of tablet mounting portion 30*b* of pivot element 30, thus providing an enhanced appearance to the adjustment mechanism. In the illustrated embodiment, tablet mounting portion 30*b*, at its end toward shaft portion 30*a*, is generally rectangular or square-shaped and corresponds to the generally rectangular or square-shaped end of upper armrest housing 28*a* when the pivot element is oriented with pivot axle 38 in a generally horizontal orientation (where the tablet may be in its stored position as shown in FIGS. 4-9) or a generally vertical orientation (where the tablet may be in its use position as shown in FIGS. 1-3). Thus, the adjustment mechanism provides generally flush or continuous outer surfaces at the end of the armrest when the tablet is stored or in use to provide an enhanced appearance to the seat assembly.

Figure 11A:
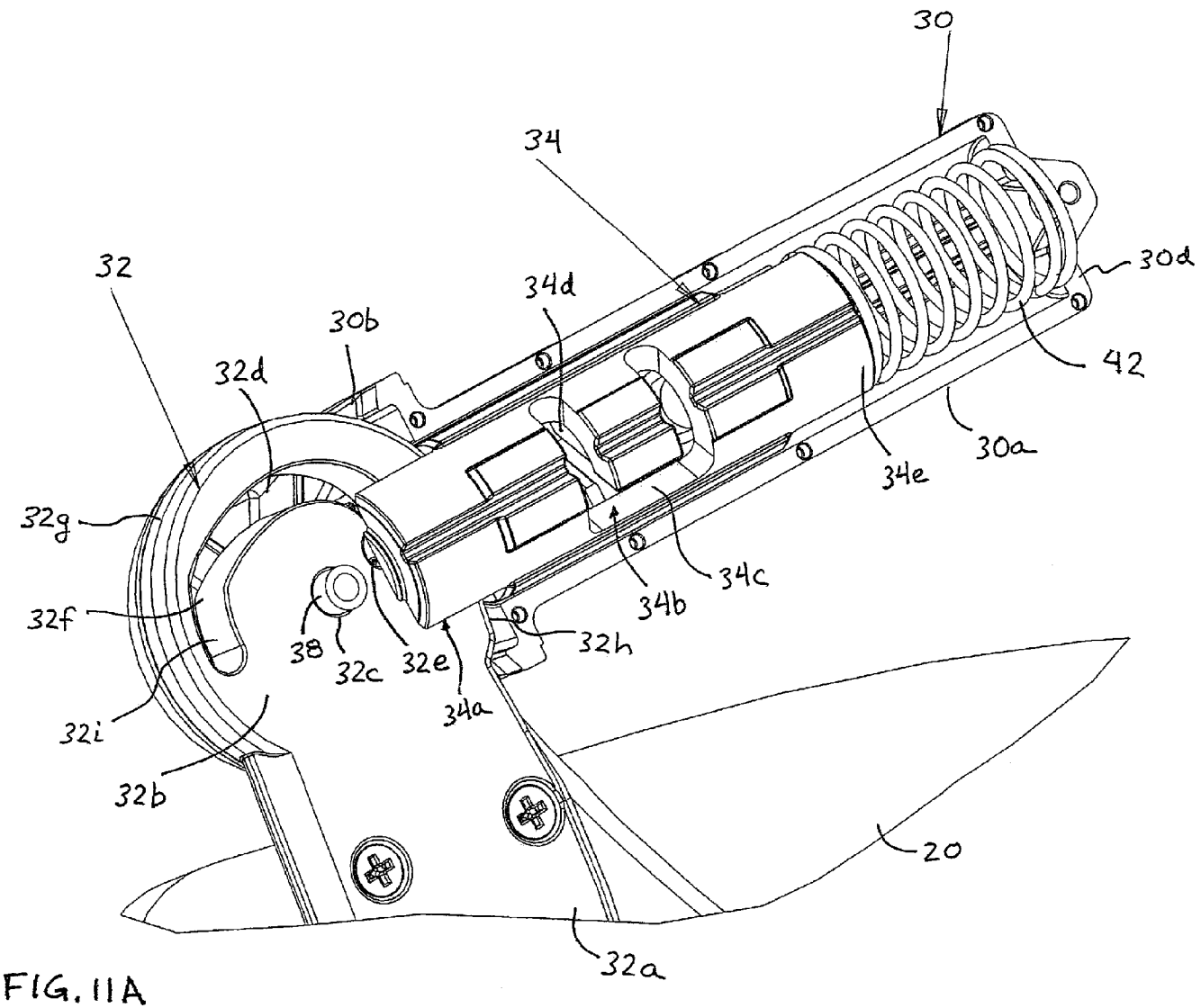
FIG. 11A is a perspective and partial sectional view of the tablet adjustment mechanism of the armrest assembly of FIG. 9, shown removed from the armrest and shown with the tablet in the lowered position.
Figure 11B:
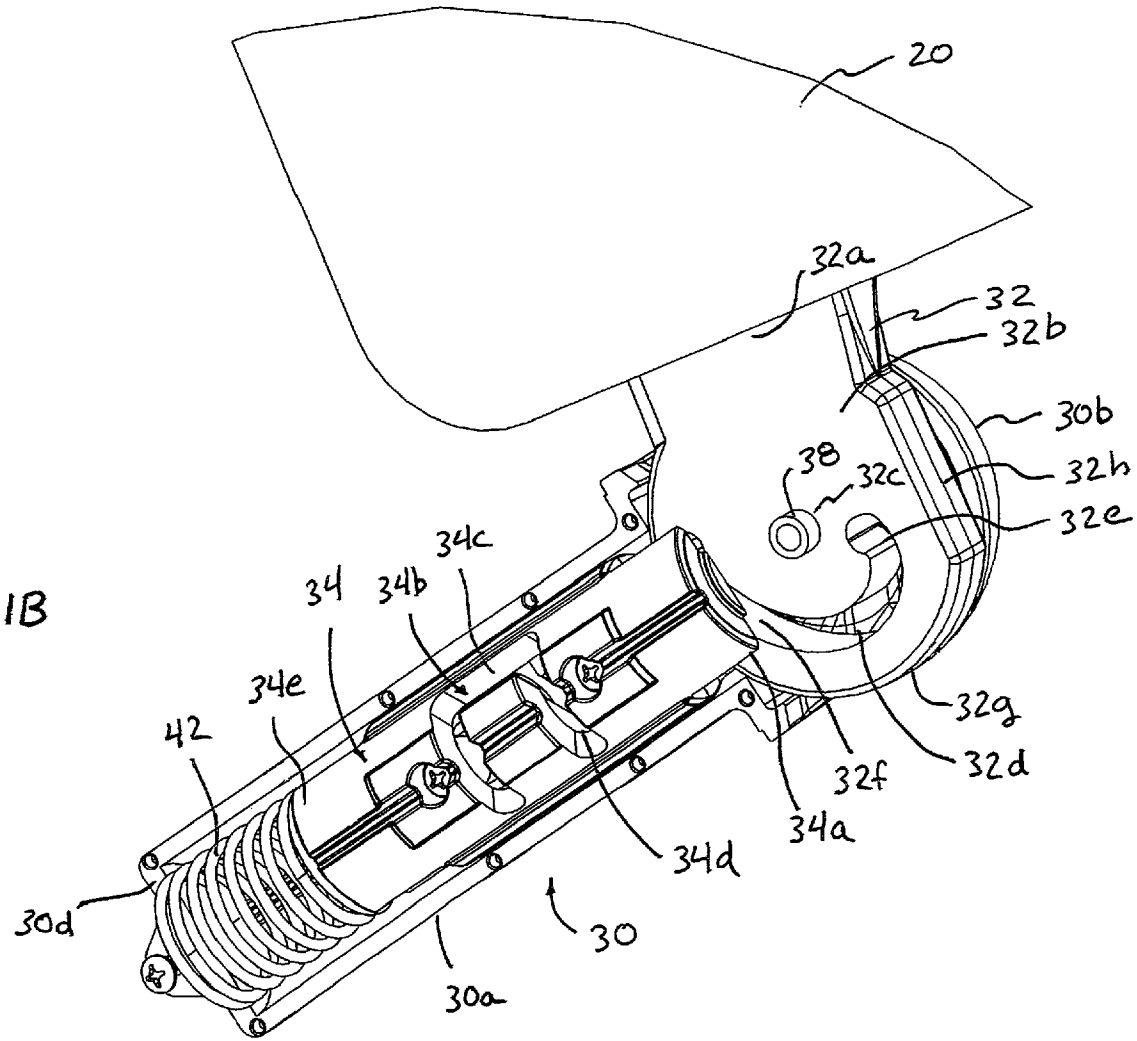
FIG. 11B is a perspective and partial sectional view of the tablet adjustment mechanism of FIG. 11A, shown with the tablet in the raised position.
Figures 12A, 12B, 12C:
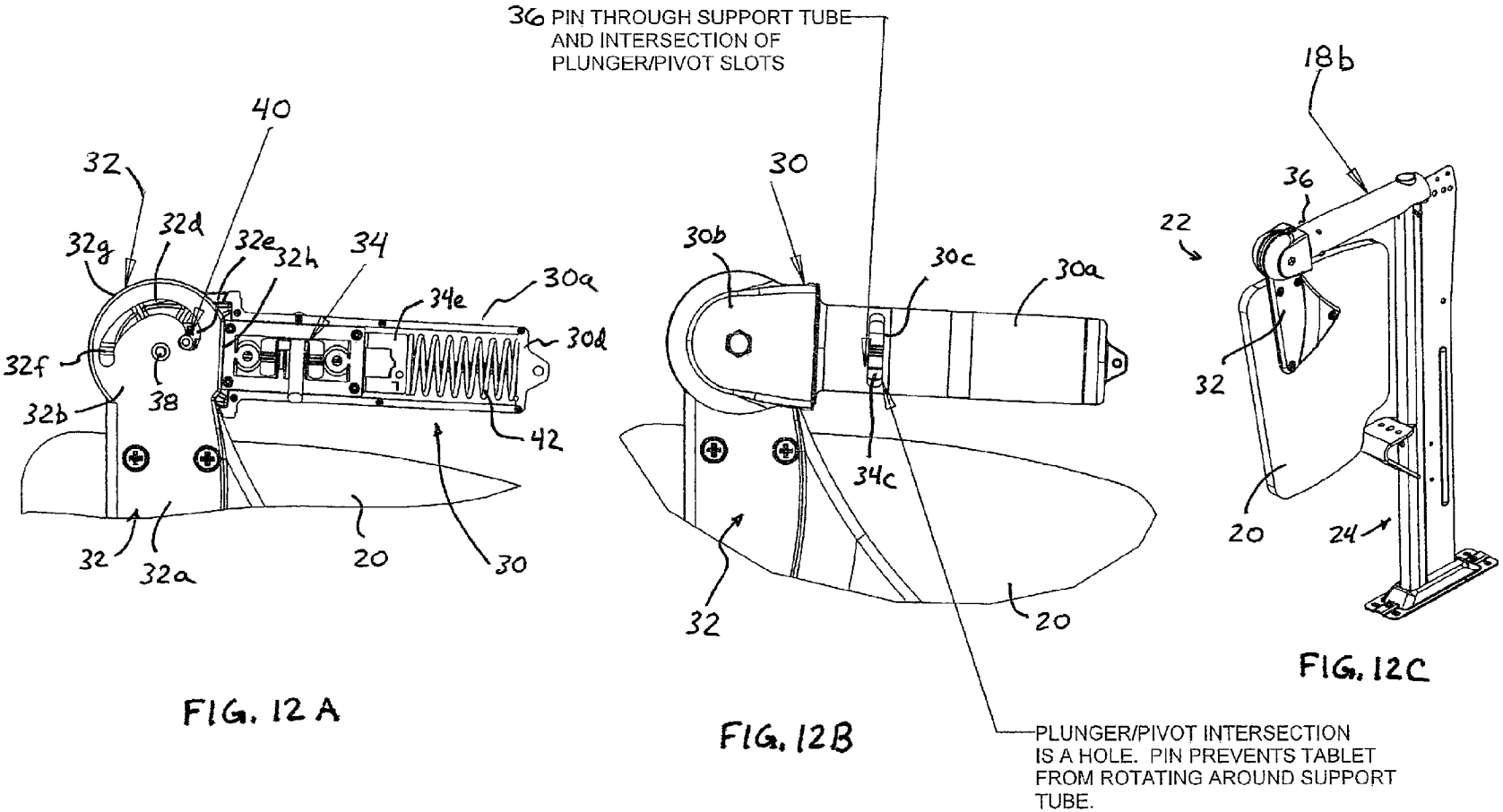
FIGS. 12A-C are side elevations and perspective views of the tablet adjustment mechanism when the tablet is in its lowered or non-use position.

As shown in FIGS. 11A and 11B, when the adjustment mechanism 22 is assembled, plunger 34 is received within shaft portion 30*a* of pivot element and is movable longitudinally along shaft portion 30*a* in response to pivotal movement of swing arm 32 about pivot axle 38. The slot 34*a* of plunger 34 receives a portion of the perimeter region of the swing arm mounting portion 32*b*, with the guide pin 40 received at least partially through the arcuate slot 32*d* of swing arm 32, and the tablet mounting portion 30*b* of pivot element 30 receives the mounting portion 32*b* of swing arm 32, such that the plunger 34 is not pivotable relative to the pivot element 30 and the plunger and pivot element pivot together about their longitudinal axes. The opposite end 34*e* of plunger 34 is engaged with a biasing element 42, such as a coil spring or the like, that is disposed between the end 34*e* of plunger 34 and an end wall or element 30*d* of pivot element 30.

The shaft portion 30*a* of pivot element 30 is received in support tube 18*b* and is retained therein via pin element 36, which is inserted through an aperture in support tube 18*b* and through the transverse slot 30*c* of pivot shaft portion 30*a* and through the slot 34*b* of plunger 34. Thus, the pin element 36 functions to limit pivotal movement of plunger 34 within pivot shaft portion 30*a* while allowing for longitudinal movement of plunger 34 when pin element 36 is received within longitudinal slot portion 34*c* of plunger 34 (FIG. 11A). Likewise, pin element 36 functions to limit longitudinal movement of plunger 34 within pivot shaft portion 30*a* while allowing for pivotal movement of plunger 34 when pin element 36 is received within transverse slot portion 34*c* of plunger 34 (FIG. 11B). The plunger 34 is longitudinally and/or pivotally adjusted (such as via movement or adjustment of swing arm 32 and tablet 20) relative to support tube 18*b* and pin element 36 to effectively position pin element 36 at different locations along the longitudinal slot portion 34*c* and transverse slot portion 34*c* of plunger 34.

Figure 6:
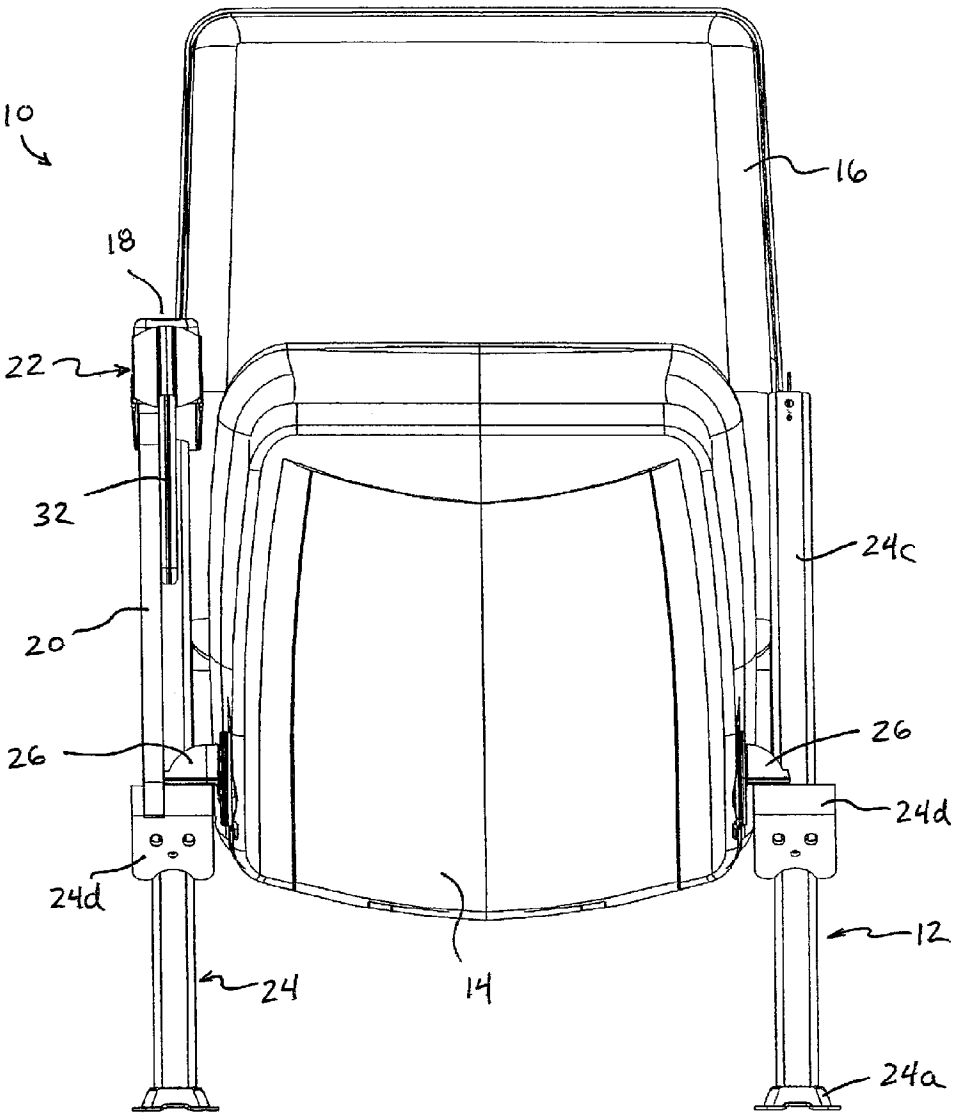
FIG. 6 is a front elevation of the seat assembly of FIG. 4.
Figure 7:
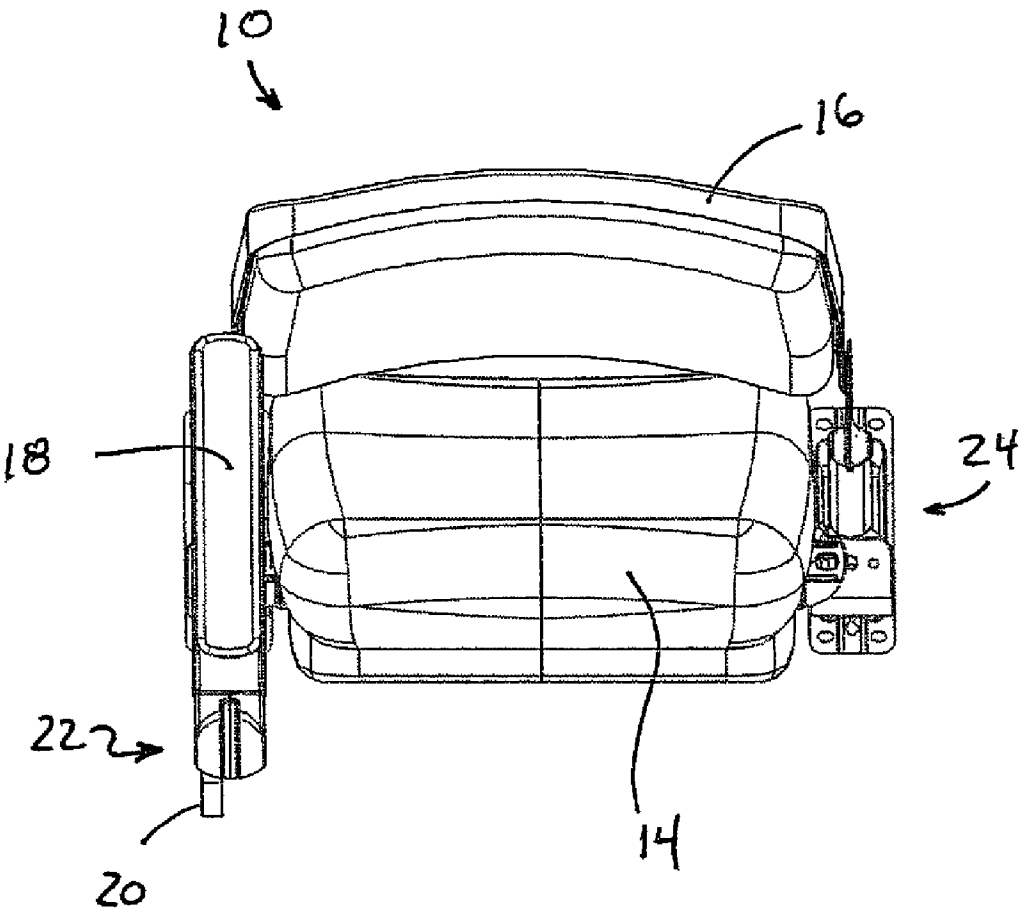
FIG. 7 is a top plan view of the seat assembly of FIG. 4.
Figure 8:
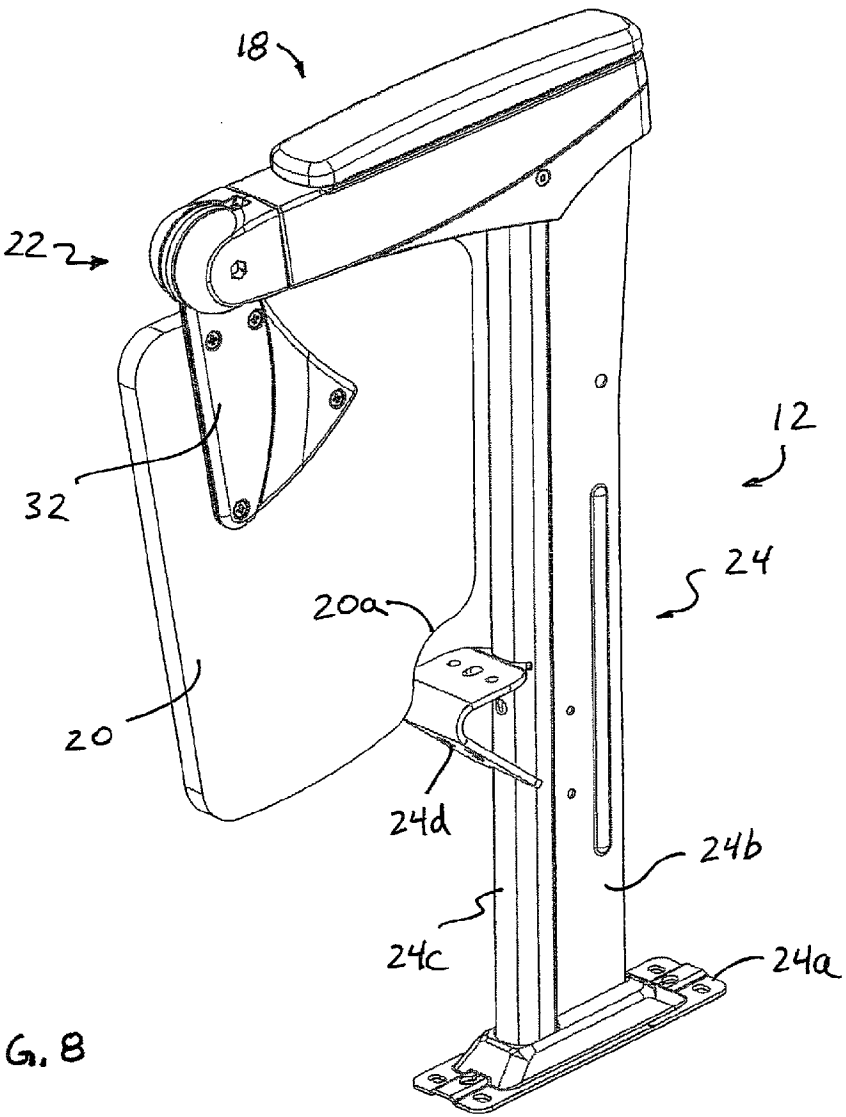
FIG. 8 is a perspective view of a mounting leg and armrest assembly of a seat assembly in accordance with the present invention, shown with the tablet in the lowered or non-use position.

For example, when swing arm 32 is at its lowered position (FIGS. 11A and 12A-C), the guide pin 40 of plunger 34 is at the smaller radius portion 32*e* of arcuate slot 32*d* of swing arm 32, and the flat stop surface 32*h* of swing arm 32 is generally at the end of the plunger 34 and received in slot 34*a* of plunger. The biasing element 42 urges plunger 34 toward the flattened stop surface 32*h* and arcuate slot 32*d* is formed so that the slot and stop surface resist pivotal movement of swing arm upward (about pivot pin or axle 38). When the swing arm 32 is in this position, the pin element 36 is received through the slot 30*c* of pivot shaft portion 30*a* and through the longitudinal slot portion 34*c* of plunger 34, whereby the intersection of the transverse slot 30*c* of pivot shaft portion 30*a* and longitudinal slot portion 34*c* of plunger 34 is generally a hole. Thus, pivotal movement of plunger 34 and/or pivot element 30 is limited by pin element 36, so that the tablet 20 is not pivotable in a lateral or sideward direction and, thus, is retained generally immediately beneath and generally centered beneath the armrest of the seat assembly when in its lowered position (as can be seen in FIGS. 6 and 7, when in its lowered or stored position, swing arm 32 is substantially centrally positioned beneath the armrest and tablet 20 is at one side of swing arm 32 and generally centered and positioned entirely beneath the armrest and not extending laterally outward beyond the lateral edge regions of the armrest).

Figures 13A, 13B, 13C:
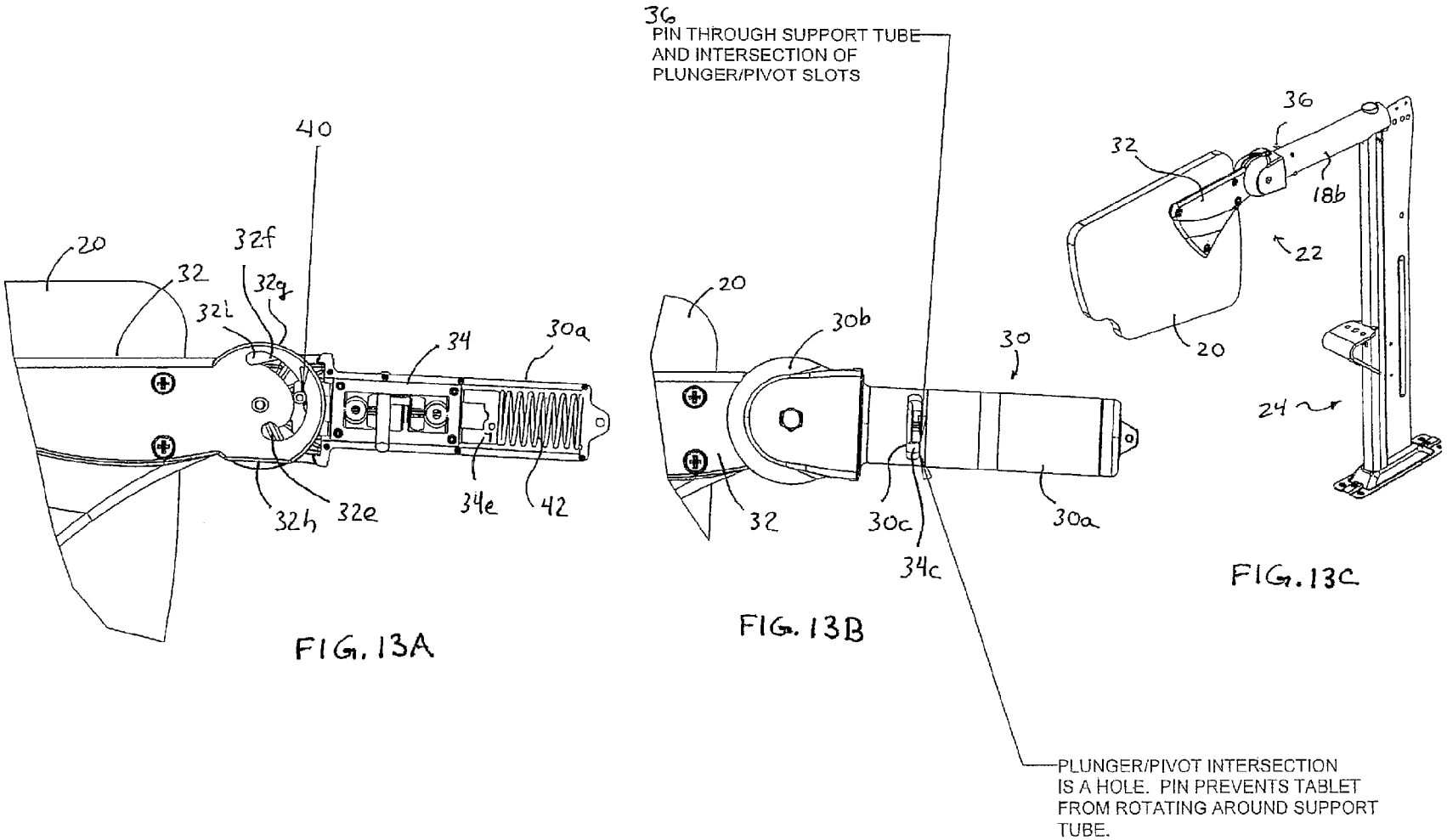
FIGS. 13A-C are side elevations and perspective views of the tablet adjustment mechanism when the tablet is in a partially raised position.

As the swing arm 32 is pivoted upward (about pivot axle 38 and relative to pivot element 30), the guide pin 40 moves along arcuate slot 32*d* (toward and into the larger radius regions), whereby the guide pin 40 is moved away from the pivot axle 38 and the plunger is moved longitudinally and translationally along pivot shaft portion 30*a* and against biasing element 42 (as shown in FIGS. 13A-C). As shown in FIGS. 13A-C, the pin element 36 is still in the longitudinal slot portion 34*c* of plunger 34 when the tablet and swing arm are positioned as shown in FIGS. 13A-C (and thus the intersection or overlap of the transverse slot 30*c* of pivot element 30 and the longitudinal slot portion 34*c* of plunger is still generally a hole), such that pivotal movement of plunger 34 and pivot shaft portion 30*a* about their longitudinal axes is still limited or substantially precluded by pin element 36.

Figure 14C:
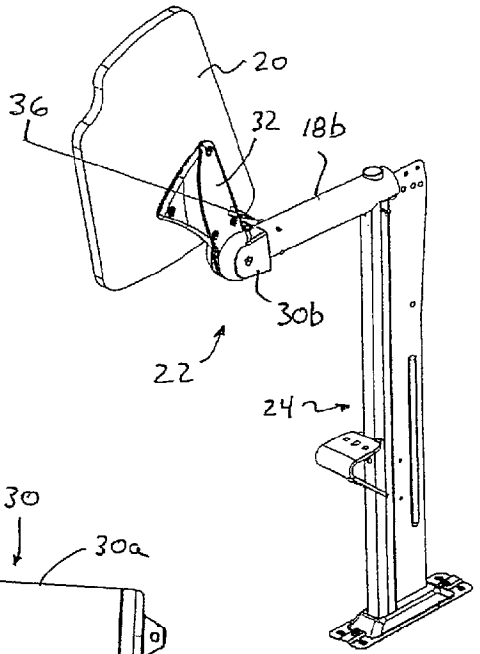
FIGS. 14A-C are side elevations and perspective views of the tablet adjustment mechanism when the tablet is in a further raised position.
Figure 14B:
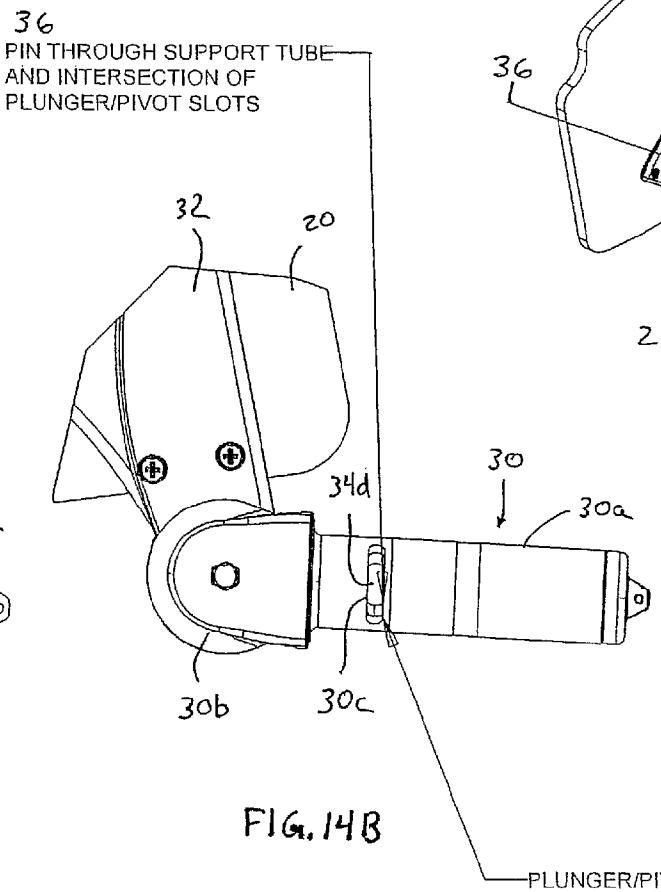
Figure 14A:
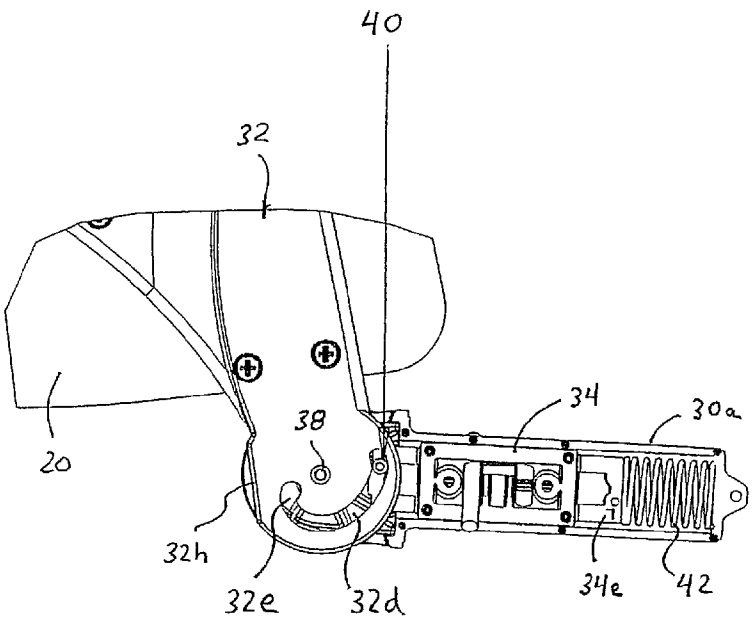

When the tablet 20 and swing arm 32 are pivoted further about pivot axle 38 to the raised position shown in FIGS. 14A-C, the guide pin 40 moves further along arcuate slot 32*d* and thus translationally moves plunger 34 further in the longitudinal direction toward the biasing element 42. When pivoted so that the guide pin 40 is generally at the larger radius portion 32*f* of arcuate slot 32*d*, the transverse plunger slot 34*d* generally aligns with the transverse pivot shaft slot 30*c* (so that the plunger/pivot intersection is a slot when the tablet and swing arm is raised to the near vertical position shown in FIGS. 14A-C), whereby the pin element 36 allows for pivotal movement of plunger 34 about its longitudinal axis and pivotal movement of pivot element 30 about its longitudinal axis, whereby the tablet 20 may be pivoted downward about the longitudinal axes to its use position (as shown in FIGS. 15A-C). The length of transverse slots 30*c* and 34*d* is set to allow for the desired range of pivotal movement of the tablet, such as about 90 degrees of pivotal movement to allow for pivoting of the tablet from its fully raised position (FIG. 14C) to its horizontal use position (FIG. 15C).

When the tablet 20 is in its horizontal use position (FIG. 15C), the pin element 36 is received in the transverse slots 30*c*, 34*d*, and thus longitudinal movement of plunger 34 within pivot element 30 is limited or substantially precluded. The tablet 20 may then be adjustable inward and outward (about the now vertical pivot axis of pivot axle 38) through a limited range of motion that is defined by or limited by a constant radius portion 32*i* (FIG. 15A) at the larger radius end portion of arcuate slot 32*d*. The constant radius portion 32*i* allows for limited pivotal movement of swing arm 32 about pivot axle 38 without any corresponding movement of plunger 34 (which is limited by pin element 36 when the tablet is in its horizontal use position). In order to lower the tablet to its stored position, the tablet is pivoted upward to a generally vertical orientation (FIG. 14C) to again align the longitudinal slot portion 34*c* with the transverse slot 30*c* and to again allow for longitudinal movement of plunger 34 and thus to allow for pivotal movement of tablet 20 and swing arm 32 about the now horizontal pivot axis of pivot axle 38 and downward toward the stored position.

In the illustrated embodiment of FIGS. 11A and 11B, plunger 34 is shown with its slot 34*b* comprising a generally U-shaped slot with a longitudinal portion 34*c* and two spaced apart transverse slot portions 34*d*, and with a slot or receiving portion 34*a* formed at each end of the plunger 34. The illustrated embodiment of plunger 34 thus is reversible so that a common plunger may be used for a right hand tablet application (as shown in FIGS. 1-7) or a left hand tablet application. For example, when in the right hand tablet application, the pin element 36 is inserted through one set of holes 18*c* in support tube 18*b* and through the slot 30*c* of pivot element 30 and the slot 34*b* of plunger 34, whereby, when the plunger is moved so that the transverse slots 34*d* and 30*c* are aligned, the plunger is pivotable in one direction about its longitudinal axis (such as in the clockwise direction as viewed from in front of the seat assembly). Likewise, when in the left hand tablet application, the plunger is reversed and pin element 36 is inserted through a different set of holes 18*d* in support tube 18*b* and through the slot 30*c* of pivot element 30 and the slot 34*b* of plunger 34, whereby, when the plunger is moved so that the transverse slots 34*d* and 30*c* are aligned, the plunger is pivotable in the opposite direction about its longitudinal axis (such as in a clockwise direction as viewed from in front of the seat assembly) to pivot the tablet in the opposite direction for moving to the use position for a left handed tablet application (the tablet would also be reversed and mounted to the other side of the swing arm for such a left hand application). Thus, the adjustment mechanism provides for common components that can be used for different applications, thereby reducing manufacturing costs and assembly processes.

Optionally, and with reference to FIGS. 16-24D, a plunger 134 of an adjustment mechanism or device 122 may be provided with a slot 134*b* through the body of plunger 134 for at least partially receiving a pin or stop element 136 that is received at least partially through a support tube 118*b* and through a transverse slot 130*c* of a pivot shaft portion 130*a* of a pivot element 130, such as in a similar manner as described above. It will be appreciated that the components and function of the adjustment mechanism 122 are substantially similar to those of the adjustment mechanism 22 of FIGS. 1-15C, so that the mechanism of FIGS. 16-24D may largely be understood with reference to the above description. Accordingly, the following description focuses on some of the differences of the mechanism 122 of FIGS. 16-24D.

Figure 16A:
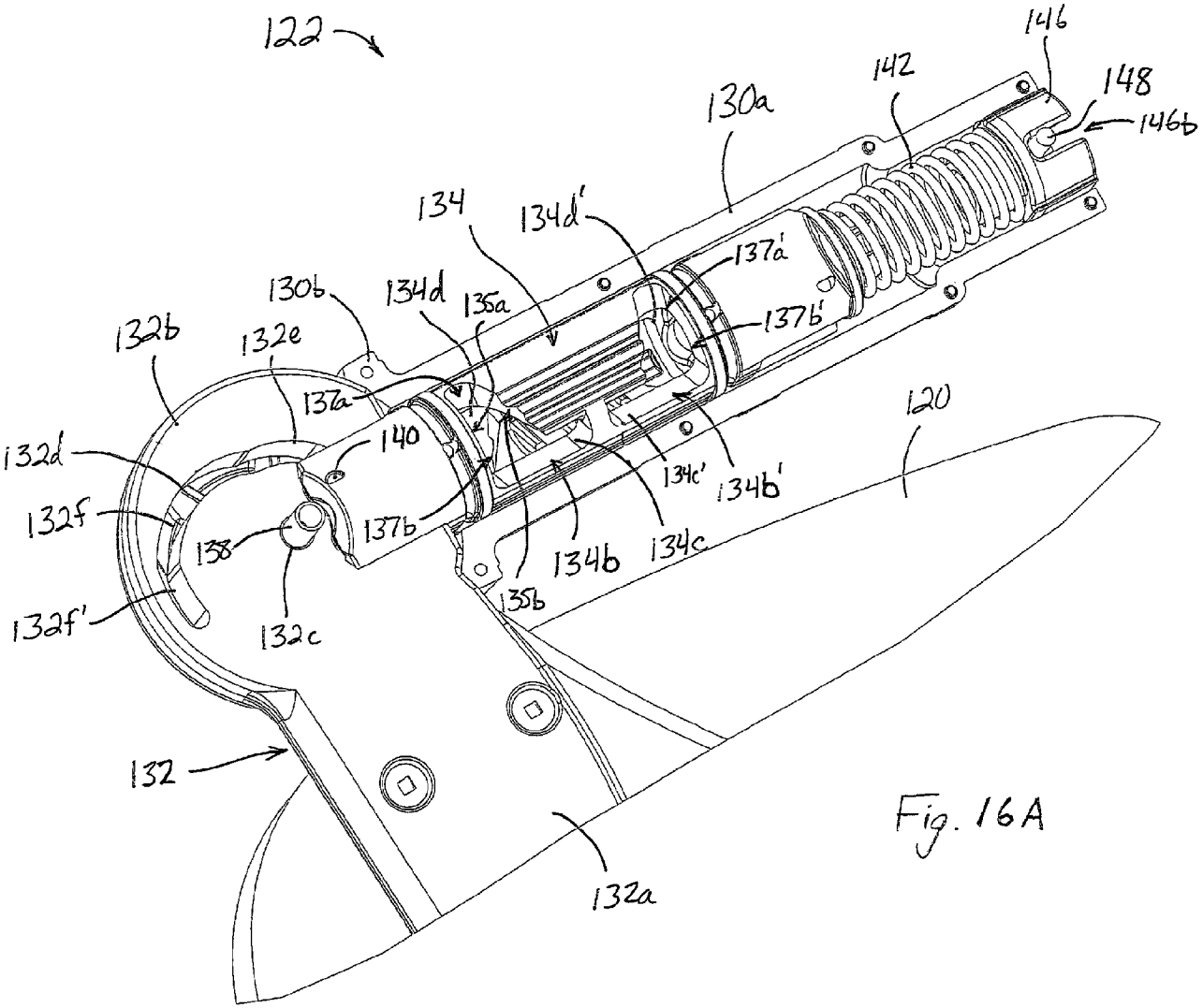
FIG. 16A is a perspective and partial sectional view of another tablet adjustment mechanism of an armrest assembly of the present invention, shown removed from the armrest and shown with the tablet in a lowered position.
Figure 16B:
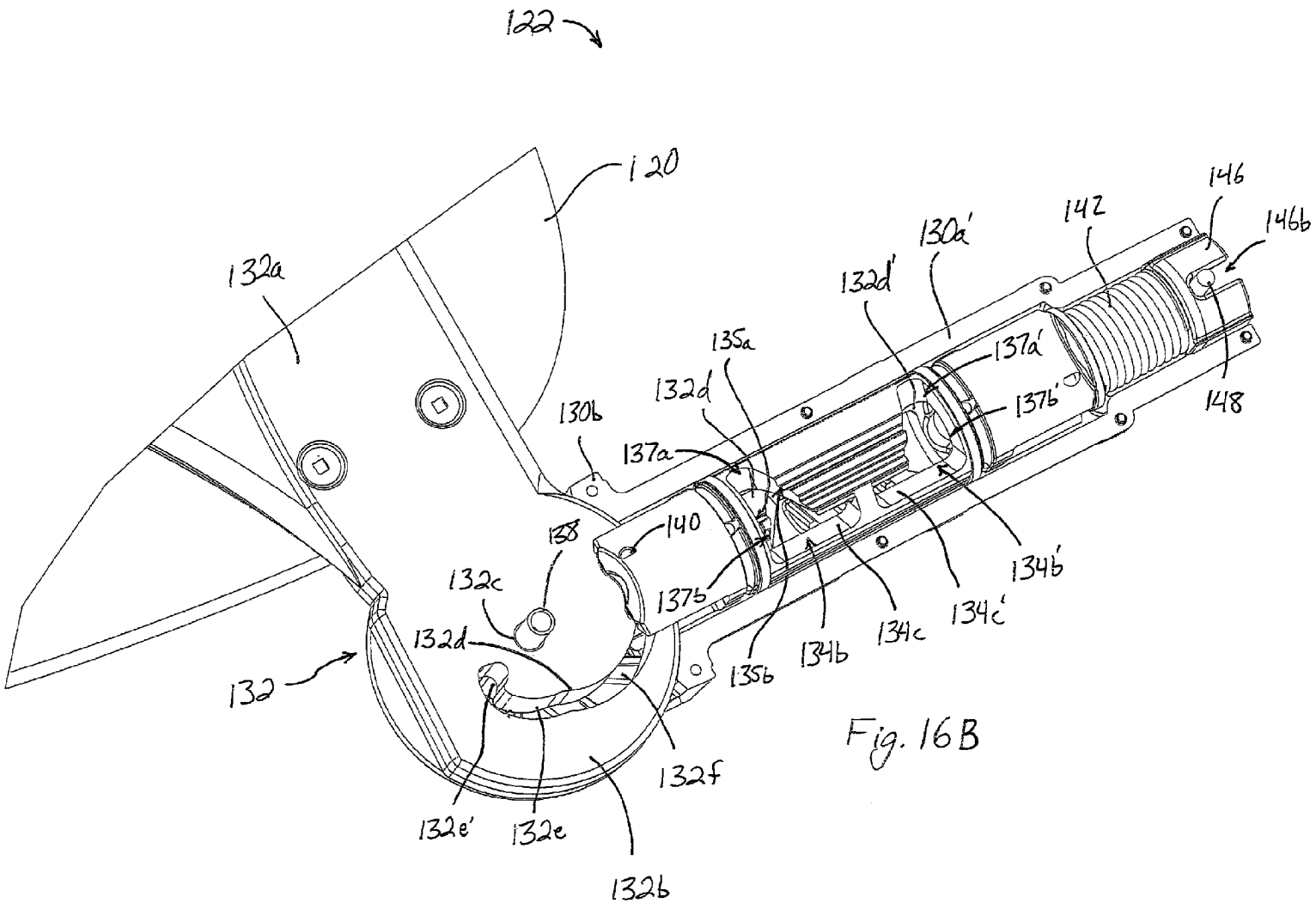
FIG. 16B is a perspective and partial sectional view of the tablet adjustment mechanism of FIG. 16A, shown removed from the armrest and shown with the tablet in a raised position.

Slot 134*b* of plunger 134 includes a longitudinal slot portion 134*c* (which extends longitudinally along plunger 134) and a generally transverse slot portion 134*d*. In the illustrated embodiment, transverse slot portion 134*d* is generally triangular-shaped and is generally defined between a forward slot surface 135*a* of plunger 134 that extends normal or transverse to longitudinal slot portion 134*e*, and a rearward slot surface 135*b* that extends at a non-perpendicular angle relative to the longitudinal slot portion 134*c* and relative to the forward slot surface 135*a* of the transverse slot portion 134*d*. Thus, transverse slot portion 134*d* has a relatively narrow end portion 137*a* (FIGS. 16A-B), approximately equal in width to the diameter of guide pin 140, where forward slot surface 135*a* and angled rearward slot surface 135*b* meet or are in their closest proximity to one another, opposite longitudinal slot portion 134*c*, and has a relatively wider end portion 137*b* adjacent at the end of and in communication with longitudinal slot portion 134*c*, where transverse forward slot surface 135*a* and angled rearward slot surface 135*b* are longitudinally spaced farther apart (FIGS. 16A-B). It will be appreciated that a second or duplicate slot portion 134*b*' may be provided at an opposite side or end of plunger 134 and arranged in mirror-image fashion relative to the first slot portion 134*b*, such as for use in left-handed applications in a similar manner as described above. As can be seen in FIGS. 16A-B and 18A-B, the plunger 134 may have separate or spaced apart longitudinal slots 134*c*, 134*c*' and respective angled or transverse slot portions 134*d*, 134*d*', as well as respective narrow end portions 137*a*, 137*a*' and wider end portions 137*b*, 137W. Optionally, the longitudinal slots may be joined to form a single longitudinal slot in communication with both transverse slot portions, such as in a manner similar to that described above with respect to longitudinal slot 34*c* of plunger 34 of mechanism 22.

A swing arm 132 includes a tablet mounting portion 132*a* that is configured to attach to a tablet 120, and includes a pivot mounting portion 132*b* that is configured to pivotally mount to a tablet mounting portion 130*b* of pivot element 130 (FIGS. 16A-17B, 18B-C and 19). Pivot mounting portion 132*b* includes an arcuate or variable radius slot 132*d* at least partially around a hole 132*c* in pivot mounting portion 132*b* for receiving a pivot axle 138, and along a perimeter region of pivot mounting portion 132*b*. The arcuate slot 132*d* has different radii from the pivot hole 132*c* that vary from a smaller radius portion 132*e* to a larger radius portion 132*f*. Smaller radius portion 132*e* further includes a small-radius detent portion 132*e*' (FIGS. 16B and 17A), while larger radius portion 132*f* includes a larger substantially constant-radius portion 132*f*' (FIGS. 16A and 17A) that permits pivoting movement of tablet 120 about pivot axle 138 without longitudinal movement of plunger 134, as will be described below.

Adjustment mechanism 122 also includes forward and rearward spring retainers 144, 146 (FIGS. 18A-C and 19), each having at least one respective projection 144*a*, 146*a* that extends axially into a respective end of a biasing element 142, such as a coil spring, to evenly support the ends of the spring. Forward spring retainer 144 is received in an aft end portion of plunger 134 and moves with the plunger along the inside of tablet mounting portion 130*b* of pivot element 130. Rearward spring retainer 146 is fixedly held inside of tablet mounting portion 130*b* and includes a pair of slots 146*b* for receiving a pin or stop element 148. A bracket 150 is received in a forward end portion of plunger 134 and receives a pin or guide element 140, which traverses arcuate slot 132*d* during pivoting of tablet 120 and swing arm 132 relative to tablet mounting portion 130*b* of pivot element 130.

Arcuate slot 132*d* provides controlled movement of plunger 134 by guiding the pin or guide element 140, which imparts a longitudinal movement of the plunger as it traverses the arcuate slot 132*d* during pivoting of tablet 120 and swing arm 132 relative to tablet mounting portion 130*b* of pivot element 130. Guide element 140 engages small-radius detent portion 132*e*' when tablet 120 is in the lowered or stowed position (FIGS. 16A and 20A-C). When guide element 140 is received in detent portion 132*e*', the tablet is in its lowered state and a flattened portion of the swing arm is engaged with an end portion of the plunger to resist movement of the tablet and to assist in returning the tablet in its stowed position. Detent portion 132*e*' provides initial resistance to pivoting movement of tablet, as guide element 140 first exits detent portion 132*e*' against the force of biasing member 142 before entering smaller radius portion 132*e*. Smaller radius portion 132*e* may be constant or nearly constant in radius, or only gradually increasing in radius, so that little or no further longitudinal movement of plunger 134 takes place as guide element 140 traverses smaller radius portion 132*e* after exiting detent portion 132*e*'. By limiting or preventing longitudinal movement of plunger 134 as guide element 140 traverses smaller radius portion 132*e* of arcuate slot 132*d*, pivotal movement of tablet during this stage of movement is resisted primarily by gravity acting upon tablet 120, and not by biasing member 142. As guide element 140 enters and begins to traverse larger radius portion 132*f* from smaller radius portion 132*e*, the distance or radius of arcuate slot 132*d* from hole 132*c* increases so that plunger 134 translates longitudinally to compress biasing member 142 as guide element 140 tracks along larger radius portion 132*f*. When the guide element 140 is at the outer end of slot portion 132*f*, the plunger and pivot element may be pivoted about their longitudinal axis to move the tablet to its use position. When in the use position, the guide element may move or track along the larger substantially constant-radius portion 132*f'* of arcuate slot 132*d*, whereby further pivoting movement of tablet 120 (and further translation of guide element 140 in slot portion 132*f'*) causes no further translation of plunger 134 or compression of biasing member 142, so that tablet 120 is free to pivot as long as guide element 140 is in the larger substantially constant-radius portion 132*f'* of arcuate slot 132*d*, thereby allowing a user to adjust the location of the tablet when it is in its use or horizontal position so as to increase or decrease the "belly room" at the tablet during use of the tablet, as will be described below.

Figure 17B:
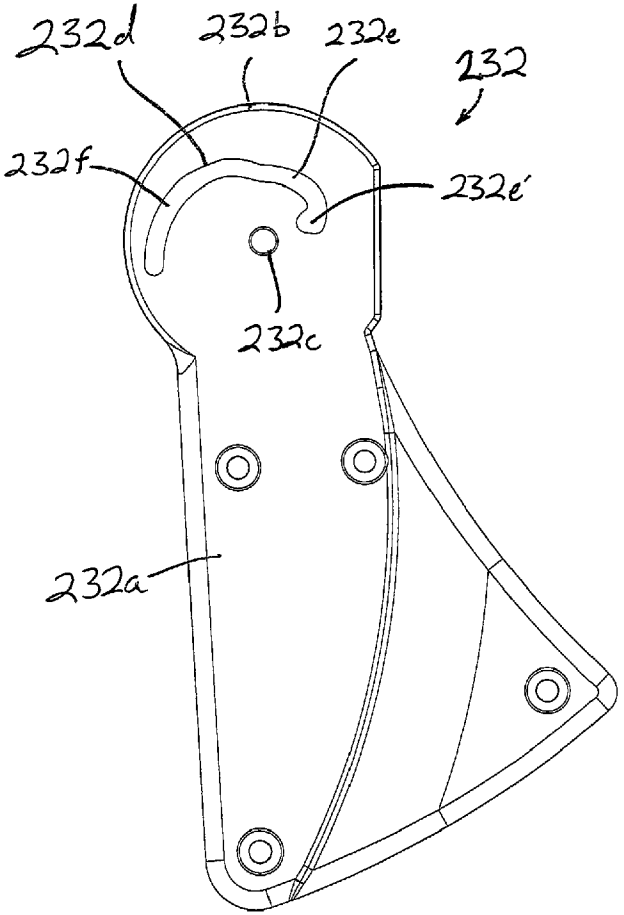
FIG. 17B is a side elevation of another swing arm, similar to the swing arm of FIG. 17A, but which does not permit pivoting of the tablet in a horizontal plane when the tablet is in a use position.
Figure 17A:
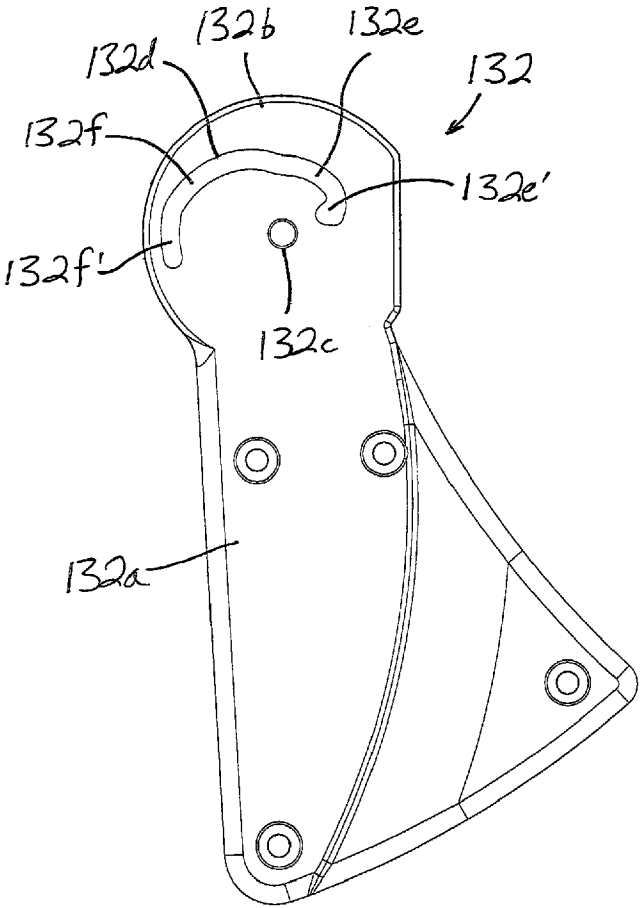
FIG. 17A is a side elevation of a swing arm of the tablet adjustment mechanism of FIGS. 16A-B, which permits pivoting of the tablet in a horizontal plane when the tablet is in a use position.
Figure 18A:
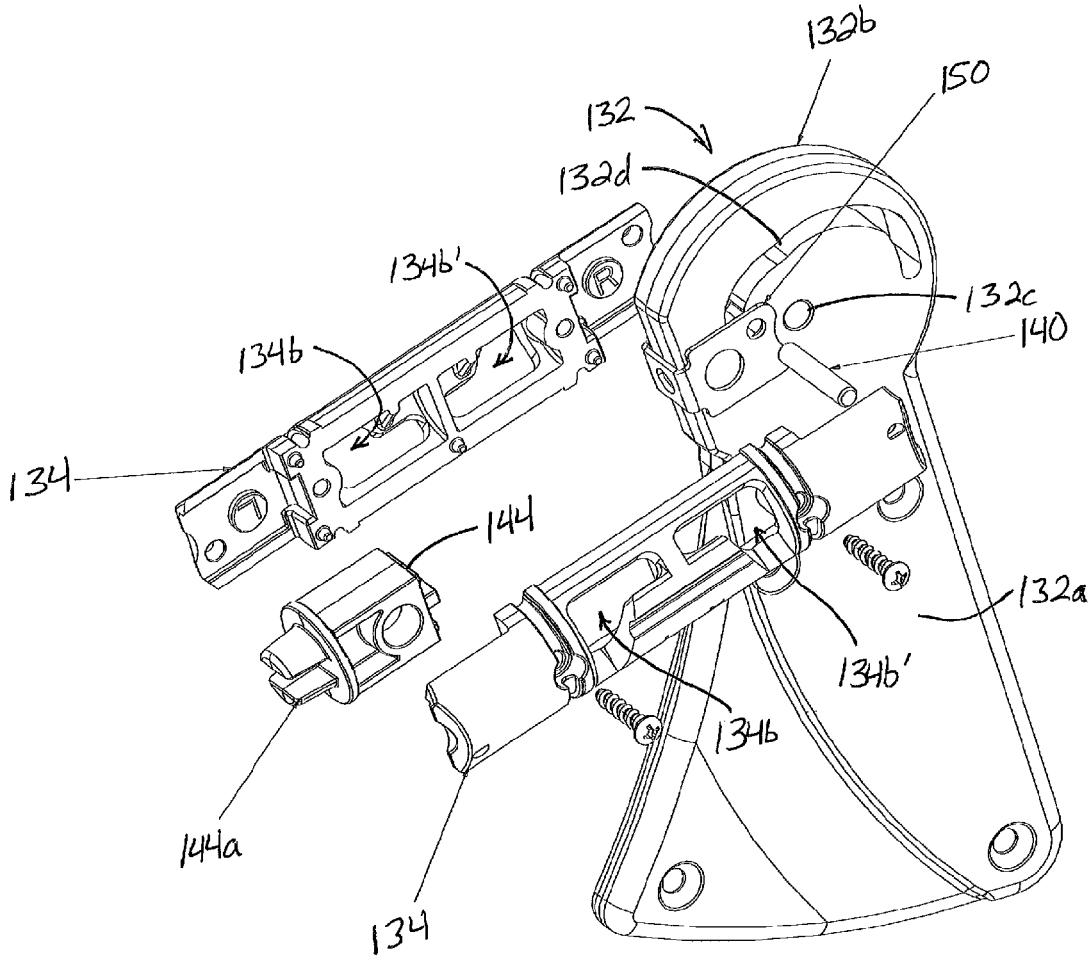
FIGS. 18A-C are perspective views of a process of assembling portions of the tablet adjustment mechanism of FIGS. 16A-B.
Figure 18B:
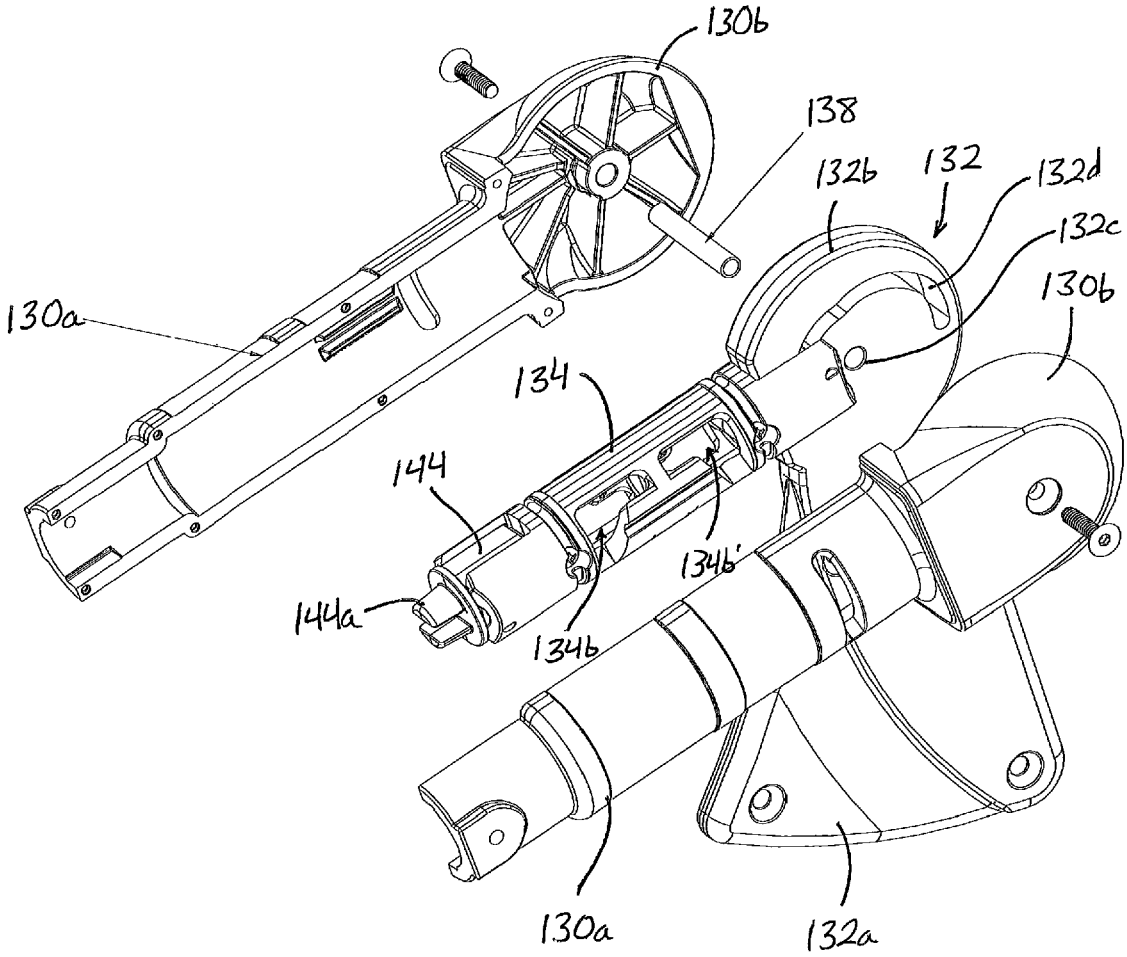
Figure 18C:
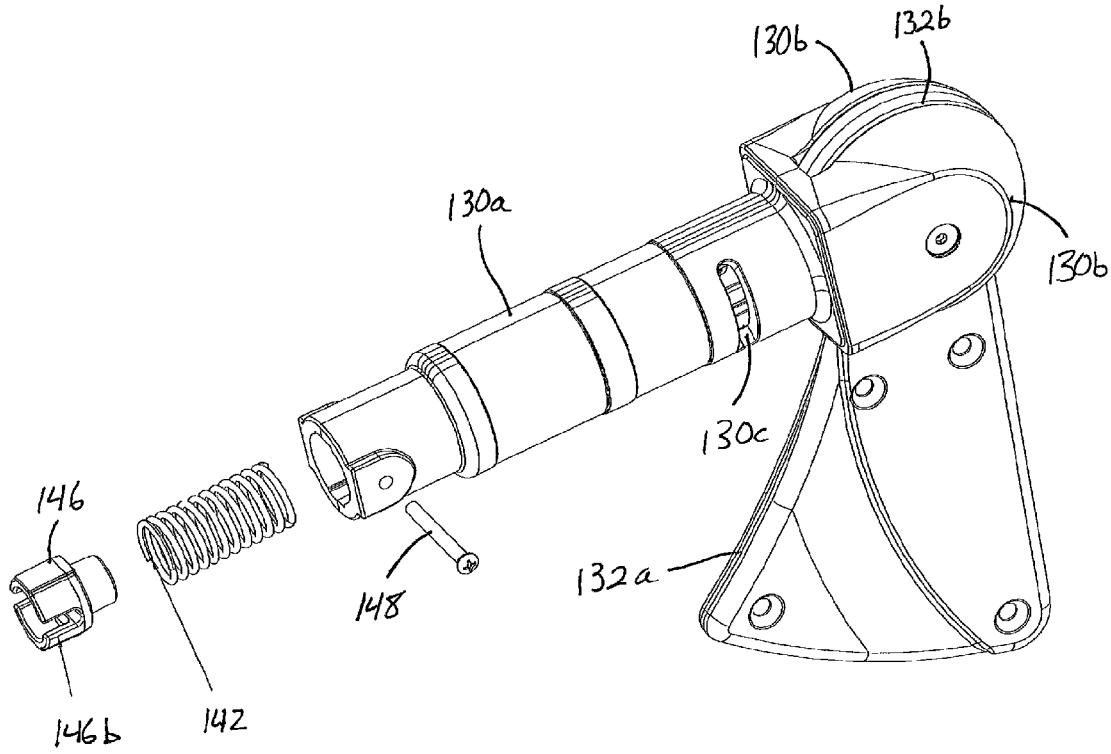
Figure 19:
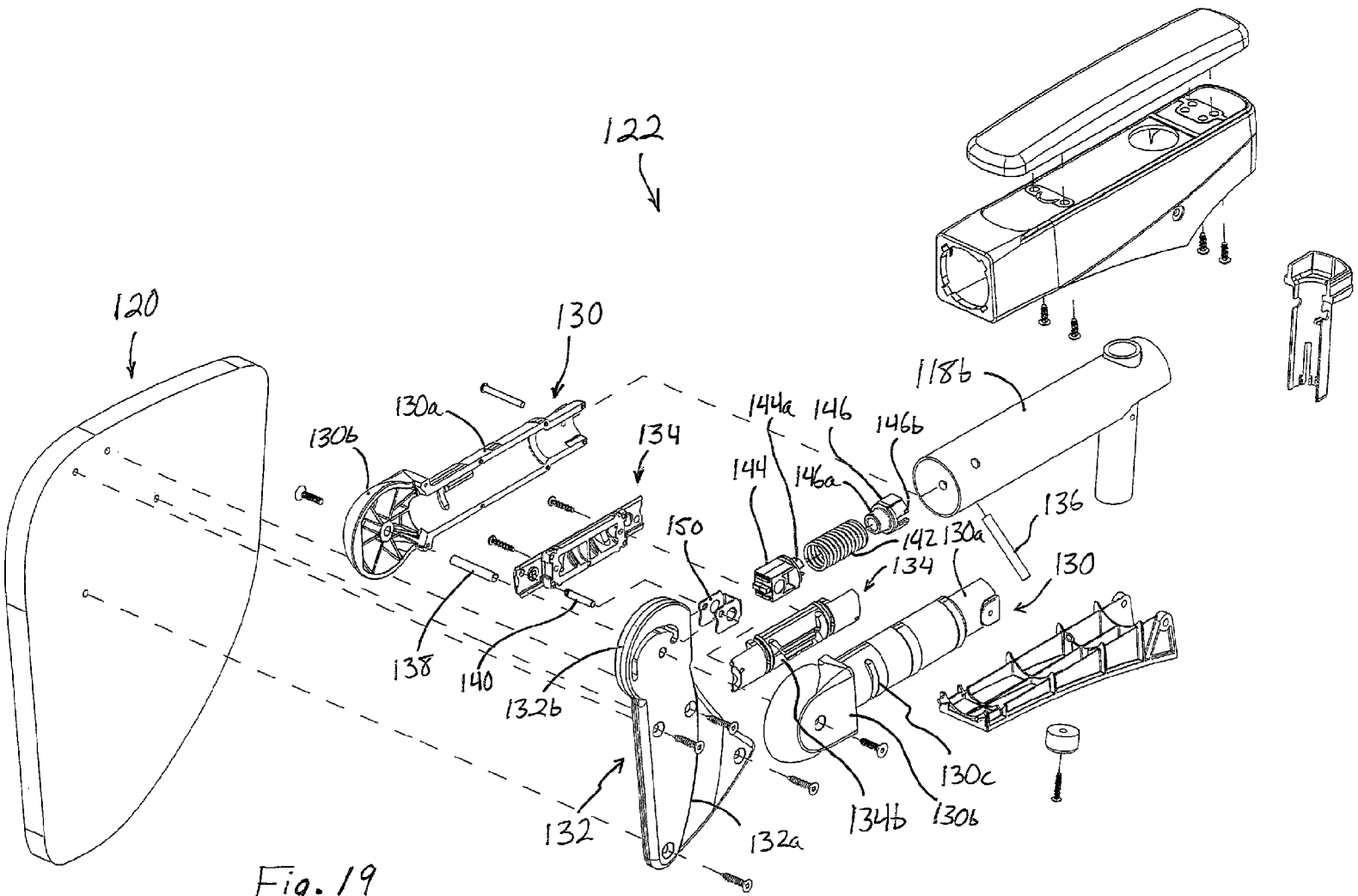
FIG. 19 is an exploded perspective view of the armrest assembly of FIGS. 16A-B.

Optionally, the swing arm may not include a constant radius slot portion or belly room adjustment feature. For example, a swing arm 232 may include a tablet mounting portion 232*a* similar to the tablet mounting portion 132*a* of swing arm 132, and may further include a pivot mounting portion 232*b* with an arcuate or variable radius slot 232*d* around a hole 232*c* (FIG. 17B). The arcuate slot 232*d* is similar to slot 132*d* of swing arm 132, and has slot portions generally corresponding to like slot portions of slot 132*d*, which slot portions are identified with reference numerals having 100 added thereto as compared to the swing arm 132 of FIG. 17A. Unlike slot 132*d*, however, slot 232*d* lacks a larger substantially constant-radius portion, so that larger radius portion 232*f* of arcuate slot 232*b* increases in its radial distance from hole 232*c* along substantially the entire length of larger radius portion 232*f*. It will be appreciated that in the illustrated embodiment of FIG. 17B, swing arm 232 is not permitted to pivot about hole 232*c* (or a pivot axle therein, not shown in FIG. 17B) after tablet 120 has been pivoted to the use position because such movement would require plunger 134 to translate longitudinally in the pivot shaft portion, but such movement is prohibited by the positioning of pin or stop element 136 at the narrow end portion 137*a* of transverse slot portion 134*d* of slot 134*b* in plunger 134, as will be described below with respect to arcuate slot 132*d*.

The tablet adjustment mechanism 122 functions similarly to that of the tablet adjustment mechanism 22, except that the range of the travel and the adjustment path of tablet 120 (FIGS. 16-24D) differs from than that of tablet 20 (FIGS. 1-15C) due to the shape of slot 134*b* in plunger 134 and the shape of arcuate slot 132*d*. When pin or stop element 136 is located in longitudinal portion 134*e* of slot 134*b*, plunger 34 is permitted to move longitudinally within pivot shaft portion 130*a* while the plunger's pivotal movement is limited, similar to pin element 36 in longitudinal portion 34*c* of slot 34*b* of plunger 34, discussed above. Thus, during the raising of tablet 120 from its lowered or stowed position (FIGS. 16A and 20A-C) to a partially-raised position (FIGS. 21A-C), the tablet is limited to pivotal movement about pivot axle 138.

When the plunger 134 is moved so that the pin element 136 is adjacent the angled rearward slot surface 135*b* of transverse slot portion 134*d*, the transverse slot portion 134*d* permits plunger 134 to rotate or pivot, to a limited degree, about its longitudinal axis. The angled rearward slot surface 135*b* of slot portion 134*d*, due to its non-perpendicular angle relative to the forward slot surface 135*a* of slot portion 134*d* and relative to longitudinal slot portion 134*c*, allows pivotal movement of the plunger so that once tablet 120 has been pivoted (about pivot axle 138) sufficiently upwardly away from its lowered or stowed position that pin element 136 enters transverse slot portion 134*d*, tablet 120 is permitted to swing laterally by virtue of positioning pin element 136 along the rearward slot surface 135*b* of slot portion 134*d* (or between the rearward and forward surfaces of slot portion 134*d*), whereby plunger 134 is permitted to pivot or rotate about its longitudinal axis when tablet 120 is raised to a vertical position (FIGS. 22A-C), and before tablet 120 reaches its use position (FIGS. 23A-C). The tablet thus may be arcuately swung or moved from its generally vertically-oriented, partially-raised position (such between positions shown in FIGS. 21C and 22C) to its generally horizontally oriented use position (such as shown in FIG. 23C) while pin element 136 tracks along the angled rearward slot surface 135*b* of transverse slot 134*d*. The forward slot surface 135*a* of slot portion 134*d*, which is generally perpendicular to longitudinal portion 134*c*, permits substantially the same movement of tablet 120 as is permitted by transverse portion 34*d* of slot 34*b* of plunger 34, discussed above. Typically, the tablet may be raised to its use position in the manner shown sequentially in FIGS. 20C, 21C, 22C and 23C, with the pin element 136 moving along the longitudinal slot 134*c* and the forward transverse slot surface 135*a* as the tablet is pivoted to its use position. The angled slot surface 135*b* allows the user to merely push the tablet outward away from the user, whereby the tablet may swing upwardly and outwardly in the manner shown in FIGS. 24A-D, with the pin element 136 moving along the angled rearward slot surface 135*b* and the longitudinal slot 134*c* as the tablet is pivoted from its use position to its stowed position. It will be appreciated that movement of the tablet could be limited to only motion that causes pin element 136 to track along rearward slot surface 135*b*, and does not permit the same tablet movement as mechanism 22, by forming the transverse slot of the plunger as a diagonal or angled and substantially constant-width slot, rather than the triangular shape of transverse slot portion 134*d*.

Thus, when in use, the tablet 120 may be pivoted about pivot axle 138 away from the person sitting in the seat and, regardless of whether the tablet is pivoted about the pivot axle, the tablet may be raised and swung in an arcuate path, upwardly and away from the seat occupant, towards its vertically oriented position. The ability to pivot tablet 120 upwardly and away from the use position, and away from a user seated in a chair equipped with the tablet adjustment mechanism 122, may be particularly useful or beneficial for persons who accidentally attempt to stand up from a seated position without returning the tablet to the lowered or stowed position. In the event of such an occurrence with adjustment mechanism 122 supporting tablet 120, the tablet typically will pivot upwardly and away from the seat occupant as the occupant moves to a standing position, such as shown in FIGS. 24A-D, and then continue to pivot and move toward its stowed position under the force of gravity and/or forces applied to the tablet by the seat occupant's legs.

Accordingly, when swing arm 132 is at its lowered position (FIGS. 16A and 20A-C), the guide pin 140 of plunger 134 is at the small-radius detent portion 132*e'* of arcuate slot 132*d* of swing arm 132, the biasing element 142 urges plunger 134 and guide pin longitudinally outwardly from pivot shaft portion 130*a* (and toward a flattened stop surface similar to stop surface 32*h* described above with respect to mechanism 22), and arcuate slot 132*d* is formed so that the slot (specifically, detent portion 132*e'*) and the stop surface resist pivotal movement of the swing arm upward (about pivot pin or axle 138). When the swing arm 132 is in this position, the pin element 136 is received through the transverse slot 130*c* of pivot shaft portion 130*a* and through the longitudinal slot portion 134*c* of plunger 134, whereby the intersection of the transverse slot

Figure 20C:
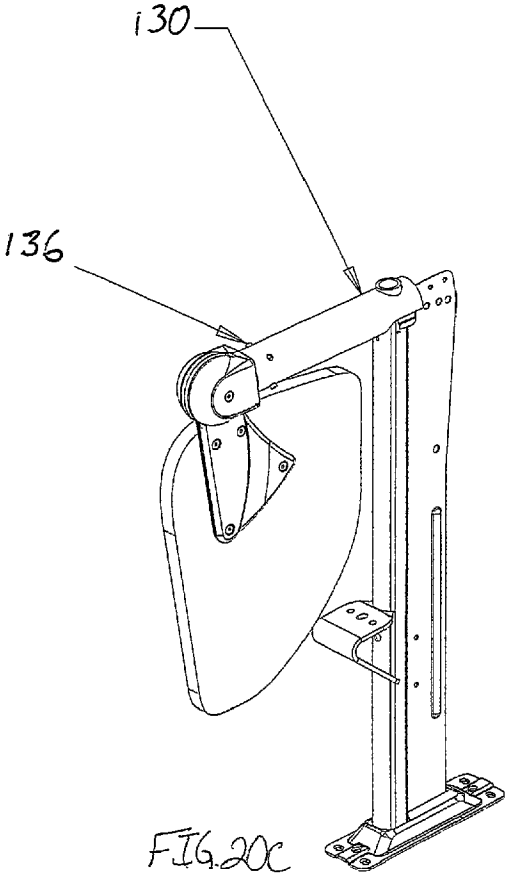
FIGS. 20A-C are side elevations and perspective views of the tablet adjustment mechanism of FIGS. 16A-B when the tablet is in its lowered or non-use position.
Figure 20B:
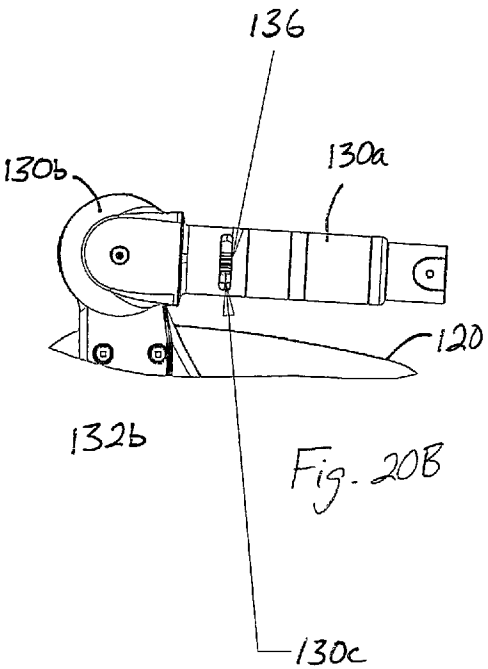
Figure 20A:
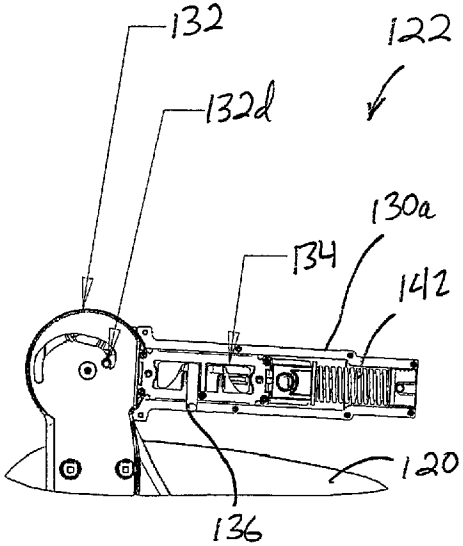

130*e* of pivot shaft portion 130*a* and longitudinal slot portion 134*c* of plunger 134 is generally a hole. Thus, pivotal movement of plunger 134 and/or pivot element 130 about their longitudinal axes or about the support tube 118*b* is limited by pin element 136, so that the tablet 120 is not pivotable in a lateral or sideward direction and, thus, is retained generally immediately beneath and generally centered beneath the armrest of the seat assembly when in its lowered position (FIG. 20C).

Figure 21C:
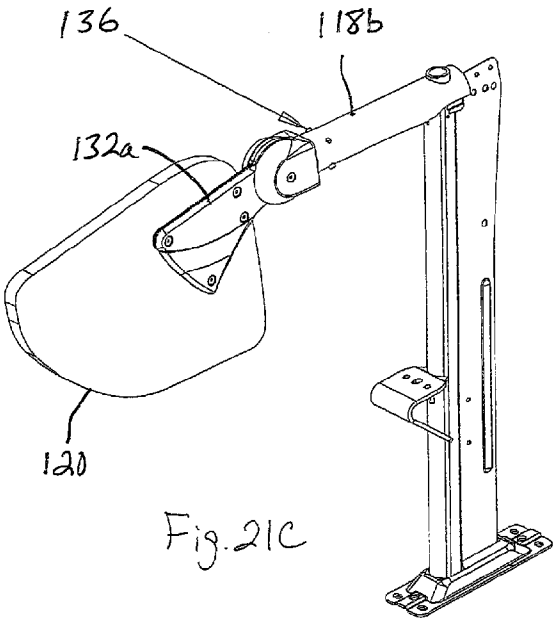
FIGS. 21A-C are side elevations and perspective views of the tablet adjustment mechanism of FIGS. 16A-B when the tablet is in a partially raised position.
Figure 21B:
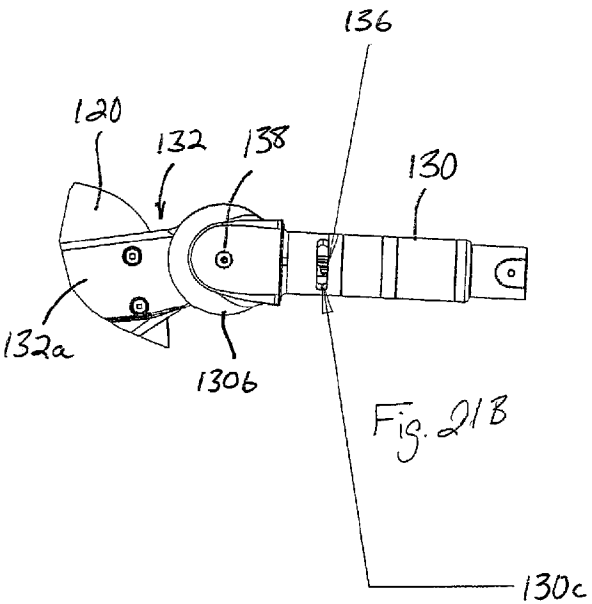
Figure 21A:
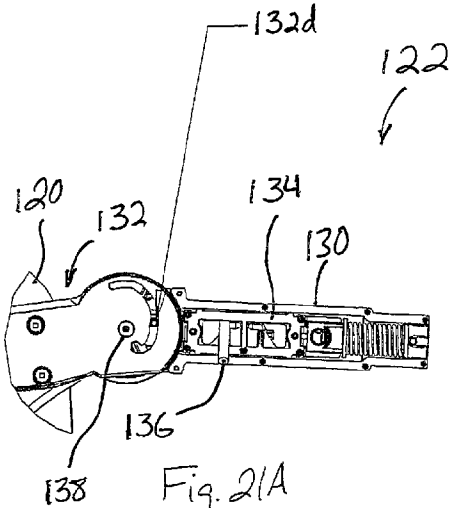

As the swing arm 132 is pivoted upward (about pivot axle 138 and relative to pivot element 130), the guide pin 140 moves along arcuate slot 132*d* (toward and into the larger radius portion 132*f*), whereby the guide pin 140 is moved away from the pivot axle 138 and the plunger is moved longitudinally and translationally along pivot shaft portion 130*a* and against biasing element 142 (as shown in FIGS. 21A-C). As shown in FIGS. 21A-C, the pin element 136 is still in the longitudinal slot portion 134*c* of plunger 134 when the tablet and swing arm are positioned as shown in FIGS. 21A-C (and thus the intersection or overlap of the transverse slot 130*c* of pivot element 130 and the longitudinal slot portion 134*c* of plunger is still generally a hole), such that pivotal movement of plunger 134 and pivot shaft portion 130*a* about their longitudinal axes is still limited or substantially precluded by pin element 136 at support tube 118*b*.

Figure 22C:
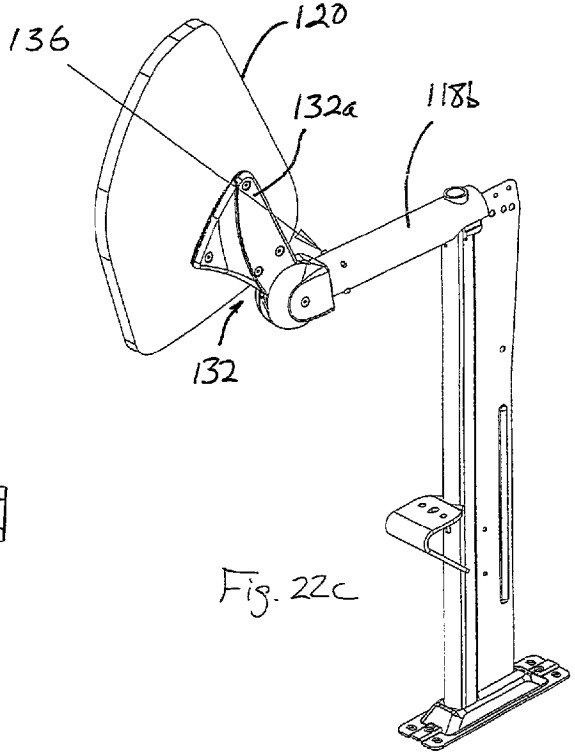
FIGS. 22A-C are side elevations and perspective views of the tablet adjustment mechanism of FIGS. 16A-B when the tablet is in a further raised position.
Figure 22B:
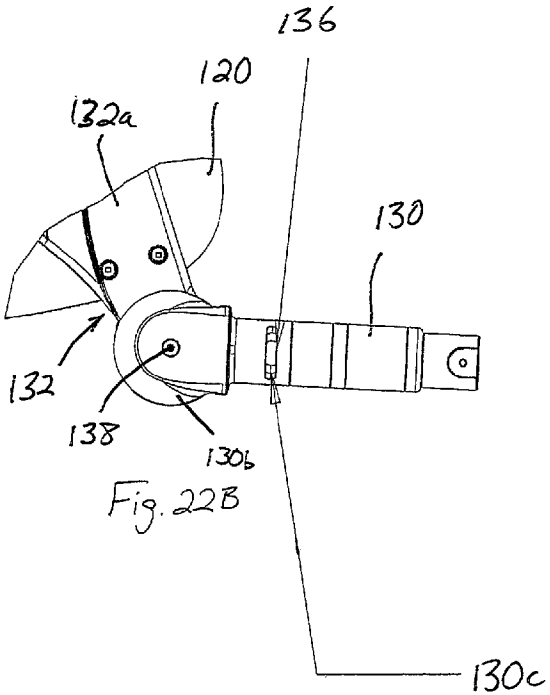
Figure 22A:
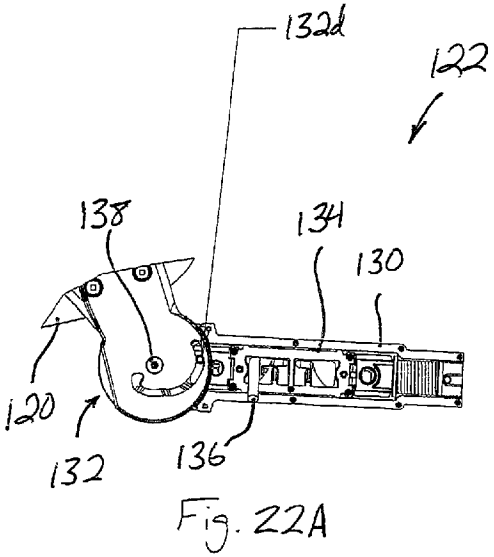
Figure 23C:
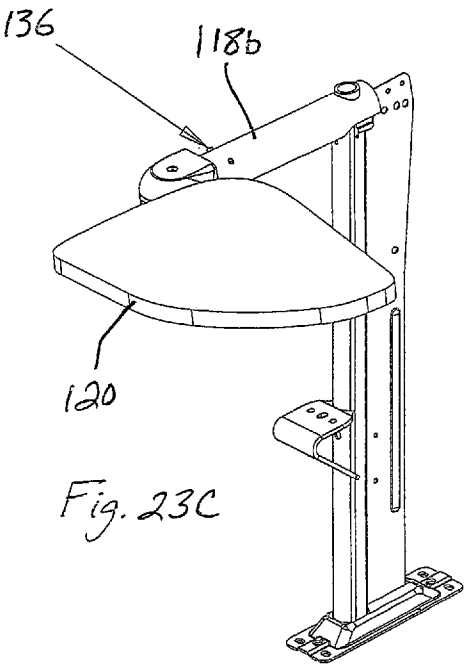
FIGS. 23A-C are side elevations and perspective views of the tablet adjustment mechanism of FIGS. 16A-B when the tablet is in its raised or use position.
Figure 23B:
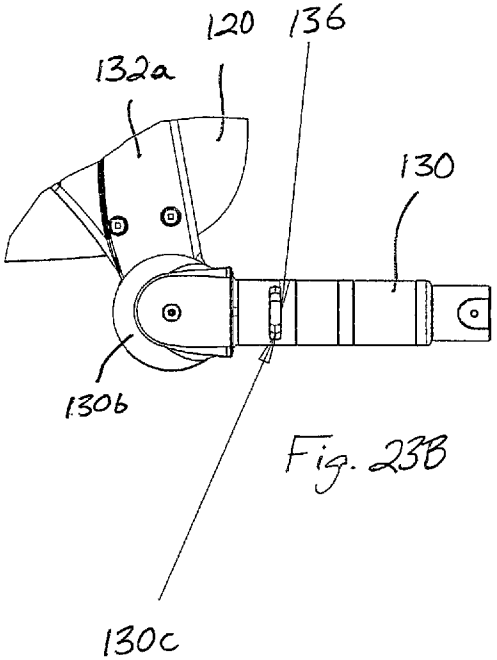
Figure 23A:
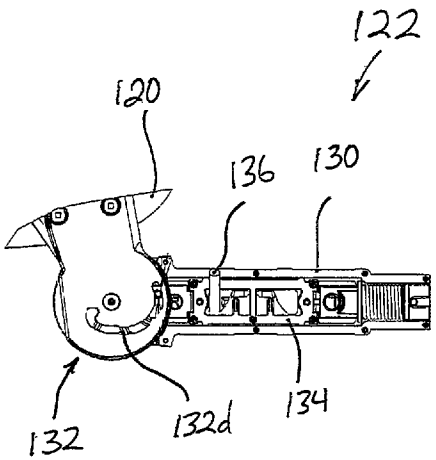
Figure 24A:
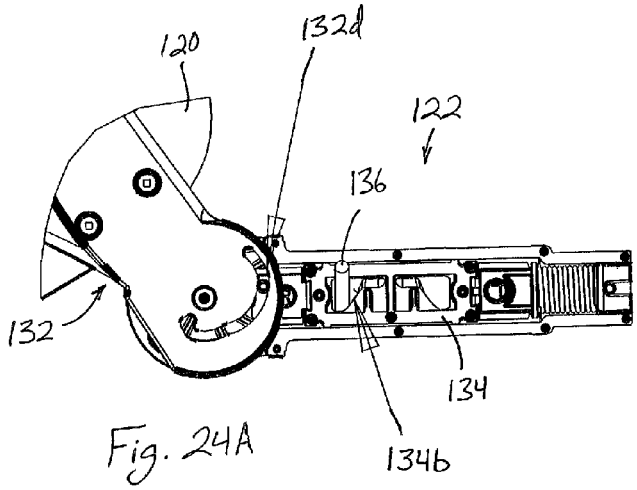
FIGS. 24A-D are side elevations and perspective views of the tablet adjustment mechanism of FIGS. 16A-B when the tablet is in an intermediate position as it is moved from the use position toward the non-use position.
Figure 24B:
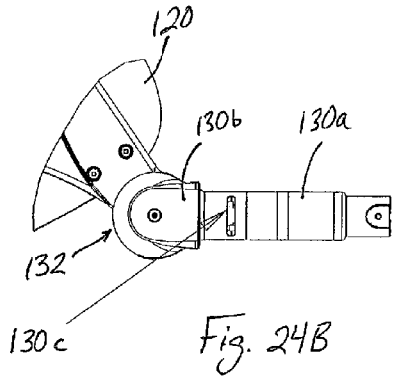
Figure 24C:
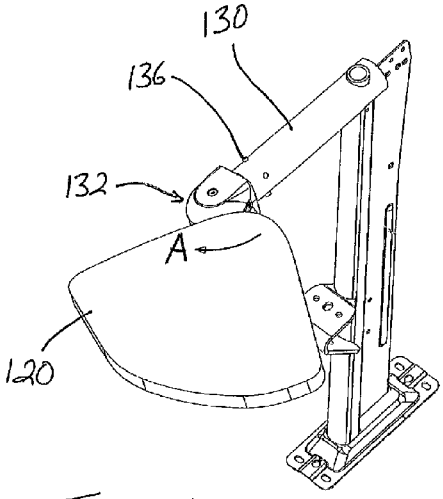
Figure 24D:
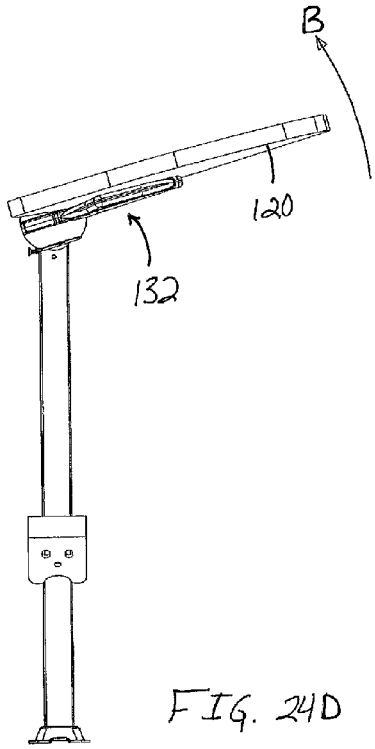

When the tablet 120 and swing arm 132 are pivoted further about pivot axle 138 to the raised position shown in FIGS. 22A-C, the guide pin 140 moves further along arcuate slot 132*d* (toward and into the larger substantially constant radius portion 132*f'*) and thus translationally moves plunger 134 further in the longitudinal direction toward the biasing element 142. When pivoted so that the guide pin 140 is generally at the larger radius portion 132*f* of arcuate slot 132*d*, the transverse plunger slot 134*d* generally aligns with the transverse pivot shaft slot 130*e*, whereby the pin element 136 allows for pivotal movement of plunger 134 about its longitudinal axis and pivotal movement of pivot element 130 about its longitudinal axis, whereby the tablet 120 may be pivoted downward about the longitudinal axes to its use position (as shown in FIGS. 23A-C). The width of the wide portion 137*b* of transverse slot 134*d* is set to permit the tablet 120 to be pivoted about the longitudinal axes even before the tablet reaches a fully or near-fully raised position as in FIGS. 21A-C. Thus, pin element 136 need not be positioned adjacent the forward slot surface 135*a* of transverse slot portion 134*d* for tablet 120 to be pivoted about the longitudinal axes, and can instead be positioned adjacent the angled rearward slot surface 135*b*, or anywhere between forward slot surface 135*a* and angled rearward slot surface 135*b*. The length of transverse slots 130*c* and 134*d* is set to allow for the desired range of pivotal movement of the tablet, such as about 90 degrees of pivotal movement to allow for pivoting of the tablet from its raised position (FIG. 22C) to its horizontal use position (FIG. 23C).

When the tablet 120 is in its horizontal use position (FIG. 23C), the pin element 136 is received in the transverse slots 130*c*, 134*d* (i.e. at narrow portion 137*a* of transverse slot portion 134*d*), and thus longitudinal movement of plunger 134 within pivot element 130 is limited or substantially precluded. The tablet 120 may then be adjustable inward and outward (about the now vertical pivot axis of pivot axle 138) through a limited range of motion that is defined by or limited by the constant radius portion 132*f'* (FIGS. 16A and 17A) at the end portion of arcuate slot 132*d*. The constant radius portion 132*f'* allows for limited pivotal movement of swing arm 132 about pivot axle 138 without any corresponding movement of plunger 134 (which is limited by pin element 136 when the tablet is in its horizontal use position). If the tablet is forced forward or outwardly beyond the limit permitted by guide pin 140 in the larger substantially constant-diameter portion 132*f'* of arcuate slot 132*d*, the angled rearward slot surface 135*b* forces the tablet to rotate around the support tube and back into the stowed position. It will be appreciated that if swing arm 232 of FIG. 17B is used, the tablet is not permitted to pivot about the pivot axle when in the horizontal use position, and any forcing of the tablet forward or outwardly will force the tablet to rotate around the support tube and back into the stowed position.

To lower the tablet from its horizontal use position to its stowed position, the tablet is pivoted upward to a generally vertical orientation (FIG. 22C) to again align the longitudinal slot portion 134*c* with the transverse slot 130*c* and to again allow for longitudinal movement of plunger 134 and thus to allow for pivotal movement of tablet 120 and swing arm 132 about the now horizontal pivot axis of pivot axle 138 and downward toward the stowed position. It will be appreciated that the tablet may alternatively be lowered to an intermediate raised position that is between a raised position (FIG. 22C), and a partially raised position (FIG. 21C), prior to fully lowering the tablet to the stowed position, via simultaneous outward and upward pivoting movement of tablet 120, such as in a motion or path illustrated by curved arrows A, B in FIGS. 24C and 24D, respectively.

Similar to the above-described lowering of tablet 120 from the fully raised position to the horizontal use position, the width of the wide portion 137*b* of transverse slot 134*d* is set to permit the tablet 120 to be pivoted upward and outward simultaneously, rather than first pivoting tablet 120 about the longitudinal axes and then pivoting the tablet about a horizontal axis, as permitted by mechanism 22. The shape of transverse slot 134*d* permits this motion because pin element 136 may be positioned adjacent the angled rearward slot surface 135*b*, or anywhere between forward slot surface 135*a* and angled rearward slot surface 135*b*, until the tablet is in a vertical orientation and lowered a sufficient amount that pin element 136 is guided entirely by longitudinal slot 134*c* of plunger 134, such as in FIGS. 21A-C. The simultaneous outward and upward pivoting movement of tablet 120 away from its use position permits the tablet to be raised and swung in an arcuate path towards its vertically oriented position, such as when a user attempts to stand from a seated position with the tablet in the use position, as described above.

Therefore, the seat assembly and adjustment mechanism of the present invention provides for controlled movement of a tablet between its lowered non-use or stowed position under the armrest and its raised or use position and further between its inward use position and outward use position. For example, the adjustment mechanism may provide for a stowed position of the tablet that is substantially centered beneath the armrest and may limit lateral or sideward movement of the tablet when the tablet is in its fully lowered or stowed position and during at least some of the pivotal movement toward its raised position, thereby allowing for a reduced spacing between adjacent seats and limiting damage to the tablet or seat that may otherwise occur if the tablet were allowed to swing laterally in its stowed and/or lowered positions. Such sideward movement limitations are provided by the mechanical elements of the adjustment mechanism and not by having the tablet contact stops or the like at the seat assembly. Also, for example, the adjustment mechanism allows for adjustment back and forth of the tablet when in its generally horizontal use position to provide enhanced ergonomics and safety to the user. The adjustment mechanism provides smooth transition between the stowed position and the use position and without multiple hinges or the like mounting the tablet to the armrest to provide additional degrees of freedom of the tablet relative to the armrest. Also, the adjustment mechanism may, for example, allow for a right hand tablet or a left hand tablet via a simple reversal of the plunger within the pivot shaft portion to readily adapt the adjustment mechanism for different applications. Therefore, the present invention provides a seating assembly or seating system with an adjustable tablet that is readily raised and lowered via an adjustment mechanism that provides for controlled movement of the tablet throughout its range of motion.

Changes and modifications to the specifically described embodiments may be carried out without departing from the principles of the present invention, which is intended to be limited only by the scope of the appended claims as interpreted according to the principles of patent law.

The invention claimed is:

1. A seat assembly comprising:

an armrest portion having a support arm;

a tablet;

an adjustment mechanism, said tablet being movable between a stowed position and a use position via said adjustment mechanism;

wherein said adjustment mechanism comprises a pivot element and a plunger element, wherein said pivot element is mounted to said support arm, and wherein said plunger element is movable relative to said pivot element in response to movement of said tablet between said stowed position and said use position;

a pin element at least partially received through said pivot element and in a slot of said plunger element;

wherein said plunger element is longitudinally moved alone said pivot element in response to pivotal movement of said tablet about a pivot axle at said pivot element, and wherein said pin element moves along a longitudinal slot portion of said slot of said plunger element when said plunger element moves along said pivot element;

wherein, when said plunger element is longitudinally moved a threshold amount relative to said pivot element, said pin element is positioned at a generally transverse slot portion of said slot of said plunger element, and wherein said plunger element and said tablet are pivotable about a longitudinal axis of said plunger element when said pin element is positioned at said generally transverse slot portion; and wherein said plunger element is selectively oriented in said pivot element in one of two orientations and wherein a first orientation is selected for a right hand tablet application where said tablet is pivoted in a first direction about said longitudinal axis to said use position, and a second orientation is selected for a left hand tablet application where said tablet is pivoted in a second direction about said longitudinal axis to said use position, said second direction being opposite said first direction.

2. The seat assembly of claim 1, wherein said tablet is generally centered beneath said armrest portion when in said stowed position, said adjustment mechanism limiting sideward movement of said tablet when said tablet is in said stowed position.

3. A seat assembly comprising:

an armrest portion having a support arm;

a tablet;

an adjustment mechanism, said tablet being movable between a stowed position and a use position via said adjustment mechanism;

wherein said adjustment mechanism comprises a pivot element and a plunger element, wherein said pivot element is mounted to said support arm, and wherein said plunger element is movable relative to said pivot element in response to movement of said tablet between said stowed position and said use position;

a pin element at least partially received through said pivot element and in a slot of said plunger element;

wherein said plunger element is longitudinally moved along said pivot element in response to pivotal movement of said tablet about a pivot axle at said pivot element, and wherein said pin element moves along a longitudinal slot portion of said slot of said plunger element when said plunger element moves along said pivot element;

wherein, when said plunger element is longitudinally moved a threshold amount relative to said pivot element, said pin element is positioned at a generally transverse slot portion of said slot of said plunger element, and wherein said plunger element and said tablet are pivotable about a longitudinal axis of said plunger element when said pin element is positioned at said generally transverse slot portion; and wherein said tablet includes an arcuate element having different radii relative to said pivot axle, said arcuate element imparting translational movement of said plunger element in response to pivotal movement of said tablet about said pivot axle.

4. The seat assembly of claim 3, wherein said arcuate element comprises an arcuate slot in said mounting portion of said tablet and a guide pin at said plunger that is at least partially received in said arcuate slot, said arcuate slot having different radii relative to said pivot axle.

5. The seat assembly of claim 4, wherein said arcuate slot includes a constant radius portion, said guide pin being positioned at said constant radius portion when said tablet is in said use position, said tablet being adjustable about a generally vertical pivot axis when in said use position via movement of said guide pin along said constant radius portion.

6. The seat assembly of claim 4, wherein said guide pin is fixed so as to be non-rotatable and adapted for sliding engagement within and along said arcuate slot.

7. The seat assembly of claim 3, wherein said pivot element is pivotable about its longitudinal axis relative to said support arm, and wherein movement of said pivot element relative to said support arm is limited by said pin element at least partially received through said support arm and said pivot element.

8. A seat assembly comprising:

an armrest portion having a support arm;

a tablet;

an adjustment mechanism, said tablet being movable between a stowed position and a use position via said adjustment mechanism;

wherein said adjustment mechanism comprises a pivot element and a plunger element, wherein said pivot element is mounted to said support arm, and wherein said plunger element is movable relative to said pivot element in response to movement of said tablet between said stowed position and said use position;

a pin element at least partially received through said pivot element and in a slot of said plunger element;

wherein said plunger element is longitudinally moved along said pivot element in response to pivotal movement of said tablet about a pivot axle at said pivot element, and wherein said pin element moves along a longitudinal slot portion of said slot of said plunger element when said plunger element moves along said pivot element;

wherein, when said plunger element is longitudinally moved a threshold amount relative to said pivot element, said pin element is positioned at a generally transverse slot portion of said slot of said plunger element, and wherein said plunger element and said tablet are pivotable about a longitudinal axis of said plunger element when said pin element is positioned at said generally transverse slot portion;

wherein said pivot element is pivotable about its longitudinal axis relative to said support arm, and wherein movement of said pivot element relative to said support arm is limited by said pin element at least partially received through said support arm and said pivot element; and wherein said pivot element includes a transverse slot, and wherein said pin element is received through said transverse slot of said pivot element, said plunger element and said tablet being pivotable about said longitudinal axis of said plunger element when said generally transverse slot portion of said plunger element generally aligns with said transverse slot of said pivot element.

9. The seat assembly of claim 8, wherein said generally transverse slot portion of said slot of said plunger element is substantially perpendicular to said longitudinal slot portion of said slot.

10. The seat assembly of claim 8, wherein said generally transverse slot portion of said slot of said plunger element is defined by a forward surface that is substantially perpendicular to said longitudinal slot portion of said slot and a rearward surface that is non-perpendicular to said longitudinal slot portion of said slot, wherein said generally transverse slot portion is configured to permit said tablet to pivot about said pivot axle while said plunger element and said tablet pivot about said longitudinal axis of said plunger element.

11. The seat assembly of claim 10, wherein said generally transverse slot portion of said plunger comprises a relatively wide end portion and a relatively narrow end portion opposite said relatively wide end portion, and wherein said pin element is received in said relatively narrow end portion of said generally transverse slot portion of said plunger when said tablet is in said use position.

12. The seat assembly of claim 11, wherein said tablet includes an arcuate element having different radii relative to said pivot axle, said arcuate element imparting translational movement of said plunger element in response to pivotal movement of said tablet about said pivot axle.

13. The seat assembly of claim 12, wherein said arcuate element comprises an arcuate slot in said mounting portion of said tablet and a guide pin at said plunger that is at least partially received in said arcuate slot, said arcuate slot having different radii relative to said pivot axle.

14. The seat assembly of claim 13, wherein said arcuate slot includes a relatively small radius portion and a larger radius portion, said guide pin being positioned at said relatively larger radius portion when said tablet is in said use position, said tablet being adjustable about a generally vertical pivot axis when in said use position via movement of said guide pin along said larger radius portion.

15. A seat assembly comprising:

an armrest portion having a support arm;

a tablet;

an adjustment mechanism, said tablet being movable between a stowed position and a use position via said adjustment mechanism;

wherein said adjustment mechanism comprises a pivot element and a plunger element, wherein said pivot element is pivotally mounted to said support arm and is pivotable about its longitudinal axis relative to said support arm, and wherein said plunger element is movable relative to said pivot element in response to movement of said tablet between said stowed position and said use position;

a pin element at least partially received through said support arm and said pivot element and in a slot of said plunger element, said pin element limiting movement of said pivot element relative to said support arm;

wherein said plunger element is longitudinally moved along said pivot element in response to pivotal movement of said tablet about a pivot axle at said pivot element and said pin element moves along a longitudinal slot portion of said slot of said plunger element when said plunger element moves along said pivot element, wherein when said plunger element is longitudinally moved a threshold amount relative to said pivot element in response to pivotal movement of said tablet about said pivot axle at said pivot element, said pin element is positioned at a generally transverse slot portion of said slot of said plunger element, wherein said plunger element and said tablet are pivotable about a longitudinal axis of said plunger element when said pin element is positioned at said generally transverse slot portion; and wherein said tablet includes an arcuate slot in said mounting portion of said tablet and a guide pin at said plunger that is at least partially received in said arcuate slot, said arcuate slot having different radii relative to said pivot axle, said guide pin imparting translational movement of said plunger element in response to pivotal movement of said tablet about said pivot axle.

16. The seat assembly of claim 15, wherein said pivot element includes a transverse slot, and wherein said pin element is received through said transverse slot of said pivot element, said plunger element and said tablet being pivotable about said longitudinal axis of said plunger element when said generally transverse slot portion of said plunger element generally aligns with said transverse slot of said pivot element.

17. The seat assembly of claim 15, wherein said plunger element is selectively oriented in said pivot element in one of two orientations and wherein a first orientation is selected for a right hand tablet application where said tablet is pivoted in a first direction about said longitudinal axis of said plunger element to said use position, and a second orientation is selected for a left hand tablet application where said tablet is pivoted in a second direction about said longitudinal axis of said plunger element to said use position, said second direction being opposite said first direction.

18. A seat assembly comprising:

an armrest portion having a support arm;

a tablet;

an adjustment mechanism, said tablet being movable between a stowed position and a use position via said adjustment mechanism;

wherein said adjustment mechanism comprises a pivot element and a plunger element, wherein said pivot element is mounted to said support arm, and wherein said plunger element is movable relative to said pivot element in response to movement of said tablet between said stowed position and said use position;

a pin element at least partially received through said pivot element and in a slot of said plunger element, said slot of said plunger element comprising a longitudinal portion and a generally transverse portion;

wherein said plunger element is longitudinally moved along said pivot element in response to pivotal movement of said tablet about a pivot axle at said pivot element, and wherein said pin element moves along said longitudinal slot portion of said slot of said plunger element when said plunger element moves alone said pivot element;

wherein when said plunger element is longitudinally moved a threshold amount relative to said pivot element, said pin element is positioned at said generally transverse slot portion of said slot of said plunger element, and wherein said generally transverse slot portion is configured to permit said tablet to pivot about said pivot axle while said plunger element and said tablet pivot about a longitudinal axis of said plunger element; and wherein said tablet includes an arcuate element having different radii relative to said pivot axle, said arcuate element imparting translational movement of said plunger element in response to pivotal movement of said tablet about said pivot axle.

19. The seat assembly of claim 18, wherein said generally transverse slot portion of said plunger comprises a relatively wide end portion arranged adjacent said longitudinal slot portion and a relatively narrow end portion opposite said relatively wide end portion, and wherein said pin element is received in said relatively narrow end portion of said generally transverse slot portion of said plunger when said tablet is in said use position.

20. The seat assembly of claim 18, wherein said arcuate element comprises an arcuate slot in a mounting portion of said tablet and a guide pin at said plunger, said guide pin being at least partially received in said arcuate slot, said arcuate slot having different radii relative to said pivot axle.

21. The seat assembly of claim 20, wherein said arcuate slot includes a relatively small radius portion and a larger radius portion, said guide pin being positioned at said relatively larger radius portion when said tablet is in said use position, said tablet being adjustable about a generally vertical pivot axis when in said use position via movement of said guide pin along said constant radius portion.

* * * * *

UNITED STATES PATENT AND TRADEMARK OFFICE

CERTIFICATE OF CORRECTION

PATENT NO. : 8,256,835 B2
APPLICATION NO. : 12/577361
DATED : September 4, 2012
INVENTOR(S) : James M. Brink and John P. Conner It is certified that error appears in the above-identified patent and that said Letters Patent is hereby corrected as shown below:

Column 2
Line 30, Delete "," after "lowered"

Column 5
Line 26, "24," should be --24.--

Column 9
Line 46, "134e" should be --134c--

Column 10
Line 1, "137W" should be --134b'--

Column 11
Line 46, Delete "than" after "from"
Line 49, "134e" should be --134c--

Column 13
Line 1, "130e" should be --130c--
Line 35, "130e" should be --130c--

Column 15
Line 34, Claim 1, "alone" should be --along--

Column 19
Line 8, Claim 18, "alone" should be --along--

Signed and Sealed this
Eighteenth Day of December, 2012

David J. Kappos

David J. Kappos
*Director of the United States Patent and Trademark Office*